US009682842B2

(12) United States Patent
Takagawa et al.

(10) Patent No.: US 9,682,842 B2
(45) Date of Patent: Jun. 20, 2017

(54) AUTOMATED ROLL TRANSPORT FACILITY

(71) Applicant: Daifuku Co., Ltd., Osaka-shi (JP)

(72) Inventors: Natsuo Takagawa, Shiga (JP); Shigeru Sugano, Shiga (JP); Keita Onoue, Shiga (JP)

(73) Assignee: Daifuku Co., Ltd., Osaka-shi (JP)

( * ) Notice: Subject to any disclaimer, the term of this patent is extended or adjusted under 35 U.S.C. 154(b) by 0 days.

(21) Appl. No.: 15/259,968

(22) Filed: Sep. 8, 2016

(65) Prior Publication Data

US 2017/0008728 A1 Jan. 12, 2017

Related U.S. Application Data

(63) Continuation of application No. 13/498,807, filed as application No. PCT/JP2010/061622 on Jul. 8, 2010.

(30) Foreign Application Priority Data

Oct. 2, 2009 (JP) ..... 2009-230737
Jul. 7, 2010 (JP) ..... 2010-154900

(51) Int. Cl.
*H04N 7/18* (2006.01)
*B65H 75/42* (2006.01)
*B65H 75/44* (2006.01)

(52) U.S. Cl.
CPC ..... *B65H 75/425* (2013.01); *B65H 75/446* (2013.01); *B65H 2405/422* (2013.01); *B65H 2511/20* (2013.01); *B65H 2553/40* (2013.01)

(58) Field of Classification Search
CPC .. B65H 75/425; B65H 75/446; B65H 19/126; B65H 2405/422; B65H 2511/20; B65H 2553/40; B65H 2220/03; B65H 2220/02
(Continued)

(56) References Cited

U.S. PATENT DOCUMENTS

2004/0073359 A1* 4/2004 Ichijo ..... B66F 9/0755 701/50
2008/0219825 A1* 9/2008 Yoshida ..... B65G 17/20 414/749.6

(Continued)

FOREIGN PATENT DOCUMENTS

CN 200988701 Y 12/2007
EP 1022553 A2 7/2000

(Continued)

OTHER PUBLICATIONS

"JP 2008-063117 Translation".*
The Method of Increasing Industrial Measurement Precision, Creator Review, Huhan, China, Apr. 1, 2009.

*Primary Examiner* — Zhihan Zhou
(74) *Attorney, Agent, or Firm* — The Webb Law Firm

(57) ABSTRACT

In order to provide an automated roll transport vehicle with which the work required to install the vehicle in a production facility is simplified, a transport carriage includes a transport vehicle side support element that supports a roll upwardly of the transport carriage such that the roll can be transferred to a receiving device, moving operation means for moving a core a of the roll supported by the transport vehicle side support element with respect to the transport carriage, control means for controlling operation of the moving operation means to locate the core a in a proper position at which both ends of the core a can be supported by a pair of device side support elements with the transport carriage stopped at a transfer location. One or more imaging device or devices for capturing an image of the device side support element is provided.

12 Claims, 13 Drawing Sheets

(58) Field of Classification Search
USPC ..... 348/95
See application file for complete search history.

(56) References Cited

U.S. PATENT DOCUMENTS

| | | | | |
|---|---|---|---|---|
| 2009/0116948 | A1* | 5/2009 | Keller | B65H 19/126 414/754 |
| 2009/0222135 | A1* | 9/2009 | Asakawa | H01L 21/681 700/253 |

FOREIGN PATENT DOCUMENTS

| | | | |
|---|---|---|---|
| JP | 4962709 | A | 6/1974 |
| JP | 62290685 | A | 12/1987 |
| JP | 829120 | A | 2/1996 |
| JP | 200863117 | A | 3/2008 |
| JP | 2008214006 | A | 9/2008 |
| JP | 2009212130 | A | 9/2009 |
| JP | 2010159134 | A | 7/2010 |
| TW | 200840780 | A | 10/2008 |

* cited by examiner

AUTOMATED ROLL TRANSPORT FACILITY

CROSS-REFERENCE TO RELATED APPLICATION

This application is a continuation of U.S. patent application Ser. No. 13/498,807, filed Mar. 28, 2012, which is a national stage application of International Patent Application No. PCT/JP2010/061622, filed Jul. 8, 2010, which claims priority to Japanese Patent Application No. 2010-154900, filed Jul. 7, 2010, and Japanese Patent Application No. 2009-230737, filed on Oct. 2, 2009, the disclosures of which are incorporated in their entireties by reference.

TECHNICAL FIELD

The present invention relates to an automated roll transport facility, and more specifically to an automated roll transport facility comprising a receiving device that is fixedly provided and that is configured to support both ends of a core that is located at a center of a roll with a pair of device side support elements located closer toward each other wherein the pair of device side support elements are configured to be moved closer toward and away from each other; a transport vehicle side support element for supporting a roll upwardly of a transport carriage such that the roll can be transferred to the receiving device; moving operation means for moving the core of the roll supported by the transport vehicle side support element with respect to the transport carriage; control means for controlling an operation of the moving operation means to locate the core in a proper position at which both ends of the core can be supported by the pair of device side support elements with the transport carriage stopped at a transfer location at which the roll is transferred to the receiving device; wherein the transport vehicle side support element, moving operation means, and the control means are provided to the transport carriage.

BACKGROUND ART

Automated roll transport facilities described above are provided in production facility to transfer rolls, in which printing stencil paper, or a film original, etc. is spooled on a hollow cylindrical core, to a receiving device provided to a production machine etc. that performs printing or spraying on the surface of printing stencil paper or various film originals. An automated roll transport facility causes a transport carriage supporting a roll to travel to a transfer location. The core of the roll is then moved by moving operation means to place the core in a proper position with the transport carriage stopped at the transfer location. And the roll can be transferred to the receiving device by supporting both ends of the core located in a proper position with a device side support.

An example of such conventional facility includes one in which a transport carriage is provided with detection means for receiving laser light from a laser light source installed in the receiving device, and in which control means is configured to control the operation of moving operation means to move the core to a proper position based on detected information from detection means, with the transport carriage stopped at a transfer location. (See, for example, Patent Document 1.)

With the facility disclosed in Patent Document 1, the detection means is provided to the transport carriage depending on the position of the laser light source provided to the receiving device such that the laser light from the laser light source is received at a proper position in the detection means when the core is located in a proper position, and such that the laser light from the laser light source is received at a position displaced from the proper position in the detection means when the core is displaced from a proper position, with the transport carriage stopped at a transfer location. And the control means is configured to control the operation of the moving operation means to move the core to a proper position based on the amount of deviation from the proper position for receiving the laser light, which serves as the detected information from the detection means.

PRIOR-ART REFERENCES

Patent Documents

Patent Document 1: JP Publication Of Application No. 2008-063117

SUMMARY OF THE INVENTION

Problems to be Solved by the Invention

In the conventional automated roll transport facility described above, because the laser light source is provided to the receiving device and the detection means is provided to the transport carriage, the work required to install the laser light source and the detection means involves working on both the receiving device and the automated roll transport vehicle. And hen installing the automated roll transport facility, it is necessary to adjust the positions of the laser light source and the detection means such that the laser light from the laser light source is received in the proper position of the detection means with the transport carriage stopped at a transfer location and with the core located in a proper position. This complicated the work to install the automated roll transport facility.

The present invention was made in light of the present state of the art described above and its object is to provide an automated roll transport facility in which work involved in installing the facility is simplified.

Means for Solving the Problems

An automated roll transport facility in accordance with the present invention comprises a receiving device that is fixedly provided and that is configured to support both ends of a core that is located at a center of a roll with a pair of device side support elements located closer toward each other wherein the pair of device side support elements are configured to be moved closer toward and away from each other; a transport vehicle side support element for supporting a roll upwardly of a transport carriage such that the roll can be transferred to the receiving device; moving operation means for moving the core of the roll supported by the transport vehicle side support element with respect to the transport carriage; and control means for controlling an operation of the moving operation means to locate the core in a proper position at which both ends of the core can be supported by the pair of device side support elements with the transport carriage stopped at a transfer location at which the roll is transferred to the receiving device; wherein the transport vehicle side support element, moving operation means, and the control means are provided to the transport carriage. At least one imaging device is provided to the transport carriage for capturing an image of the device side support element wherein the learning control means is configured to control operation of the moving operation means to locate the core in the proper position based on image information captured by the at least one imaging device.

That is, the control means can determine the actual position of the core with respect to the actual device side support element by capturing an image of the device side support element with at least one imaging device with the transport carriage stopped at the transfer location, and by obtaining the image position of the device side support element in the image captured by the imaging device as well as relative position information, in the captured image, between the device side support element and the core whose image is captured with the image of the support element. Therefore, the control means can control the operation of the moving operation means to locate the core in the proper position based on the captured image information.

Because the control means can locate the core in the proper position by controlling the operation of the moving operation means based on the image information captured by at least one imaging means, the core can be located in the proper position when transferring the core to the receiving device so that both ends of the core can be supported accurately by the pair of device side support elements.

And because the imaging device or devices is/are provided to the transport carriage such that an image of the device side support element can be captured therewith with the transport carriage stopped at the transfer location, the work involved in installing the imaging device does not include working on the receiving device. Therefore, the work required to install the automated roll transport facility is simplified. In addition, for example, when the imaging device or devices is/are provided to the transport vehicle so as to be moved with the core, proper positioning of the imaging device or devices for capturing the device side support element can be set based on the positional relationship between the core and the imaging device or devices. The imaging device or devices can be provided to the transport carriage in advance and prior to installation in a production facility such that image of the device side support element may be captured appropriately. This also simplifies the work required to install the automated roll transport facility in a production facility.

Therefore, an automated roll transport facility is provided which can simplify work involved in installing the facility.

In an embodiment of the present invention, as the least one imaging device, a single imaging device is preferably provided to a carriage main body of the transport carriage to which the transport vehicle side support element is provided such that the single imaging device captures images of the device side support element and the core simultaneously. And the learning control means is preferably configured to control the operation of the moving operation means to locate the core in the proper position based on the image information of the device side support element and the core captured by the single imaging device.

That is, because the core can be located in the proper position by capturing the images of the device side support element and the core simultaneously by the single imaging device with the transport carriage stopped at the transfer location and by controlling the operation of the moving operation means to move the core based on the image information of the device side support element and the core that is simultaneously captured by the single imaging device, the core can be located in the proper position when transferring the core to the receiving device so that both ends of the core can be supported accurately by the pair of device side support elements.

To describe in more detail, if, for example, the single imaging device is provided to the carriage main body such that the images of the device side support element and the core are simultaneously captured in a horizontal direction from the front side in the vehicle body fore and aft direction, the image of the core is captured such that the core in the image is in the proper position with respect to the device side support element when the core is located in the proper position. And the image of the core is captured such that the core in the image is displaced from the proper position in the image vertical direction or in the image lateral direction when the core is displaced from the proper position in the vertical direction or in the vehicle lateral direction respectively. And because the actual position of the core with respect to the actual device side support element in the vertical direction and the vehicle body lateral direction can be determined from the position of the core with respect to the device side support element in the captured image, the core can be located in the proper position by controlling the operation of the moving operation means based on the image information of the device side support element and the core that is captured simultaneously by one imaging device.

And because the images of the device side support element and the core are simultaneously captured by a single imaging device, and because the operation of the moving operation means is controlled to locate the core in the proper position based on the position of the core with respect to the device side support element in the captured image, cost is reduced because of the fewer number of imaging devices and the processing of the control means can be simplified, when compared with the facility where the images of the device side support element and the core are individually captured by two imaging devices, and where the operation of the moving operation means is controlled based on the position information of the two imaging devices and on the position information of the device side support element and the core in the images captured by the two imaging devices.

Therefore, an automated roll transport facility is provided in which the cost can be reduced and the processing of the control means can be simplified.

In an embodiment of the invention, the moving operation means is preferably configured to move the core in a vertical direction, a vehicle body lateral direction, and in a vehicle body fore and aft direction, wherein a first imaging device and a second imaging device whose imaging directions intersect each other as seen along an axis of the core are preferably provided as the at least one imaging device, and wherein the learning control means is preferably configured to determine amounts of displacement of the core from the proper position in the vertical direction, the vehicle body lateral direction, and in the vehicle body fore and aft direction based on the image information captured by the first imaging device and the second imaging device, and to control the operation of the moving operation means to locate the core in the proper position.

That is, the core can be located in the proper position by capturing the image of the device side support element by the pair of imaging devices consisting of the first imaging device and the second imaging device with the transport carriage stopped at the transfer location, by controlling the operation of the moving operation means based on the image information captured by the pair of imaging devices, and by moving the core in the vertical direction, the vehicle body lateral direction, and in the vehicle body fore and aft direction. Because the proper position is a proper position, in all of the vertical direction, the vehicle body lateral direction, and the vehicle body fore and aft direction, at which the core can be supported by the pair of device side support elements, both ends of the core can be supported accurately by the pair of device side support elements when transferring the core to the receiving device.

To describe in more detail, for example, the control means is caused to store, in advance, position information of each of the first imaging device and the second imaging device as well as intersection angle information between the optical axis of one imaging device and the optical axis of the other imaging device. Then the amounts of displacement of the core from the proper position in the vertical direction, the vehicle body lateral direction, and in the vehicle body fore and aft direction can be determined based on the position of the device side support element in the image captured by one imaging device, on the position of the device side support element in the image captured by the other imaging device, on the position information of the first imaging device and the second imaging device, and on the intersection angle information. Therefore, the core can be located in the proper position with respect to all directions including the vertical direction, the vehicle body lateral direction, and the vehicle body fore and aft direction by controlling the operation of the moving operation means based on the image information captured by the first imaging device and the second imaging device. And by locating the core in the proper position in this manner, both ends of the core can be supported accurately by the pair of device side support elements when transferring the core to the receiving device, even if the accuracy with which the transport carriage is stopped is not high or even if the position of the core with respect to the device side support elements is displaced due to vibration during transporting or before the transporting starts.

Therefore, because the core can be located in the proper position with respect to all directions including the vertical direction, the vehicle body lateral direction, and the vehicle body fore and aft direction, an automated roll transport facility can be provided in which both ends of the core can be supported accurately by the pair of device side support elements when transferring the core to the receiving device.

In an embodiment of the present invention, the moving operation means is preferably configured to move each of the both ends of the core separately in the vertical direction, the vehicle body lateral direction, and in the vehicle body fore and aft direction, wherein at least one first side imaging device that captures an image of one of the pair of device side support elements and at least one second side imaging device that captures an image of the other of the pair of device side support elements are preferably provided as the said at least one imaging device, and wherein the learning control means is preferably configured to control the operation of the moving operation means to locate one end portion of the core in the one end portion proper position corresponding to the proper position based on the image information captured by the at least one first side imaging device, and to locate the other end portion of the core in the other end portion proper position corresponding to the proper position based on the image information captured by the at least one second side imaging device.

That is, one end portion of the core can be located in the one end portion proper position by capturing the image of one of the pair of device side support elements by at least one first side imaging device with the transport carriage stopped at the transfer location and by controlling the operation of the moving operation means to move the one end portion of the core based on the image information captured by the first side imaging device or devices. And the other end portion of the core can be located in the other end portion proper position by capturing the image of the other of the pair of device side support elements by at least one second side imaging device with the transport carriage stopped at the transfer location and by controlling the operation of the moving operation means to move the other end portion of the core based on the image information captured by the second side imaging device or devices.

And the tilting of the core can be changed so that the core is located in the proper position by locating the one end portion of the core in the one end portion proper position and locating the other end portion of the core is in the other end portion proper position. Therefore, even if the core is tilted with respect to the proper attitude (attitude of the core located in the proper position) when the transport carriage is stopped at the transfer location, the core can be moved into a proper attitude by correcting the attitude of the core to alleviate the tilting so that the core can be located in the proper position; thus, both ends of the core can be supported accurately by the pair of device side support elements when transferring the core to the receiving device.

Therefore, because the attitude of the tilted core with respect to the proper attitude can be corrected so that the core can be located in the proper position, an automated roll transport facility is provided in which both ends of the core can be supported accurately by the pair of device side support elements when transferring the core to the receiving device.

In addition, a first imaging device and a second imaging device whose imaging directions intersect each other as seen along an axis of the core are preferably provided as the at least one first side imaging device, and wherein a third imaging device and a fourth imaging device whose imaging directions intersect each other as seen along the axis of the core are preferably provided as the at least one second side imaging device.

The conventional technology includes a facility that includes a pair of imaging devices that are directed toward the far side where a detected object is located and that capture images of the detected object from the closer side, and determination means for determining the position of the detected object in the depth-wise direction based on the image positions of the detected object in the pair of images captured by the pair of imaging devices.

In such conventional facility, the image of the detected object were captured from the closer side with the pair of imaging devices with the pair of imaging devices being located on the closer side in the depth-wise direction with respect to the intersection of the optical axes and being separately located on either side of the intersection of the optical axes in a width direction which perpendicularly intersects the depth-wise direction such that their optical axes intersect each other. And there was a facility in which a detecting range is defined to be a range that spans from the closer side to the far side of or with respect to the intersection of the optical axes and in which determination means is configured to determine the position of the detected object in the detecting range with respect to the reference position in the depth-wise direction based on the difference of the image positions of the detected object in a pair of images captured by the pair of imaging devices. (See, for example, JP Publication of Application No. H08-29120.)

In the conventional facility described above, the detecting range in which the position of a detected object with respect to the reference position in the depth-wise direction is determined by the determination means is defined to be a range that span from the closer side to the far side of the intersection of an optical axis. And the position of the detected object located at or near the intersection of the optical axes is also determined.

However, experimental results show that, when the detected object is located at or near the intersection of the optical axes, the reliability of the position of the detected object obtained by the determination means is low and that the determination of the position of the detected object with respect to the reference position is unreliable.

By way of describing this experiment, the experiment was conducted in which the detected object was moved incrementally from a position that was on the closer side of and 30 mm away from the intersection of the optical axes to a position that was on the far side of and 30 mm away from the intersection of the optical axes, and in which the position of the detected object was determined by determination means at each of these positions.

In this experiment, as shown in FIG. 9, a pair of CCD cameras C1, C2, that functioned as the pair of imaging devices, were separately located at positions such that their distance (545 mm) from the intersection o of the optical axes is equal, and such that the intersecting angles (51.3 degrees) of the optical axes with line segments parallel to the depth-wise direction were equal. In addition, the pair of CCD cameras C1, C2 were positioned such that their optical axes were horizontally oriented and were in the same horizontal plane as the detected object W, and such that, as shown in FIG. 10(*b*), the detected object W' and W" were located at the same position in the pair of images captured by the pair of CCD cameras C1, C2 when the detected object W was located at the intersection of the optical axes. FIG. 10 (*b*) is a drawing in which the pair of images captured by the pair of imaging devices are superimposed on each other, and in which W' is the detected object W captured by the right hand side CCD camera C1, and W" is the detected object W captured by the left-hand side CCD camera C2. In addition, a cylinder body, whose diameter is 145 mm, is used as the detected object W.

Each of FIGS. 10 (*a*) and 10 (*c*) is a drawing in which the pair of images captured by the pair of imaging devices are superimposed on each other. FIG. 10 (*a*) shows the image captured by the pair of CCD cameras C1, C2 when the detected object W was located on the closer side of and 110 mm away from the intersection of the optical axes. And FIG. 10 (*c*) shows the image captured by the pair of CCD cameras C1, C2 when the detected object W was located on the far side of and 150 mm away from the intersection of the optical axes. And the difference (shown by the arrows in FIGS. 10 (*a*) and (*b*)) between the center positions of the detected objects W', W" in the pair of images is used as the difference of the image positions of the detected object W.

As a result, the difference between the image positions of the detected object W gradually diminishes when the detected object W was moved from the closer side with respect to the intersection o of the optical axes toward the intersection o of the optical axes, and the difference between the image positions of the detected object W gradually increases when the detected object W is moved from the intersection o of the optical axes toward the far side. Therefore, as shown in FIG. 11, the graph, showing the relationship of the difference of the image positions of the detected object W versus the actual positions of the detected object W in the depth-wise direction, has a V-shape.

And FIG. 12 is a graph showing the amount of changes in the image position of the detected object W when the detected object W was moved from the closer side toward the far side by a set distance. As shown in FIG. 12, when the detected object W was moved at locations, on the closer side or on the far side, that are separated from the intersection o of the optical axes by a large distance, the difference between the image positions of the detected object W changed uniformly or approximately uniformly in proportion to the movement of the actual detected object W. However, when the detected object W was moved at and near the intersection o of the optical axes, the difference between the image positions of the detected object W does not change uniformly or approximately uniformly in proportion to the movement of the actual detected object W.

Thus, the reliability of the position of the detected object obtained by the determination means is believed to be low and the determination of the position of the detected object with respect to the reference position is believed to be unreliable if the position of the detected object W is determined based on the difference between the image positions of the detected object W which does not change uniformly or approximately uniformly in proportion to the movement of the actual detected object W.

Therefore, in the embodiment of the present invention, a first imaging device and a second imaging device whose optical axes intersect each other at an intersection as seen along an axis of the core are preferably provided as the at least one imaging device, wherein the learning control means preferably includes determination means for determining a position of the core with respect to the reference position in a depth-wise direction that is directed from a closer side toward a far side and that extends along a second imaginary line that extends perpendicular to a first imaginary line that connects the first imaging device and the second imaging device and that passes through the intersection of the optical axes, based on the difference between the image positions of the core in the pair of images captured by the first imaging device and the second imaging device, and wherein the determination means is preferably configured to define a non-detecting range to be a range whose distance from the intersection of the optical axes is less than a set distance and which is defined on a closer side and on a far side of the intersection of the optical axes, and in which a determination of a position, with respect to the reference position, of a detected object which is at least the device side support element becomes unreliable, and to define a detecting range to be a range whose distance from the intersection of the optical axes is greater than or equal to the set distance and which is defined on a closer side or on a far side of the intersection of the optical axes, and to determine the position with respect to the reference position in the depth-wise direction of the detected object in the detecting range based on a difference between image positions of the detected object in the pair of images captured by the first imaging device and the second imaging device.

That is, because a determination of a position, with respect to the reference position, of the detected object which is at least the device side support element becomes unreliable in the range whose distance from the intersection of the optical axes is less than a set distance, and which is defined on the closer side and on the far side of the intersection of the optical axes in the depth-wise direction, this range is defined to be the non-detecting range. And because a determination of a position, with respect to the reference position, of the detected object is reliable or nearly reliable in the range whose distance from the intersection of the optical axes is greater than or equal to the set distance, and which is defined on the closer side or on the far side of the intersection of the optical axes in the depth-wise direction, this range is defined to be the detecting range. And the determination means is configured to determine the position of the detected object in the detecting range with respect to the reference position in the depth-wise direction based on the difference of the image positions of the detected object in the pair of images captured by the pair of imaging device consisting of the first imaging device and the second imaging device.

Thus, the position of the detected object with respect to the reference position in the depth-wise direction can be determined by the determination means reliably or nearly reliably by defining the detecting range, in which the position of the detected object with respect to the reference position in the depth-wise direction is determined by the determination means, to be the range whose distance is greater than or equal to the set distance from the intersection of the optical axes and which is defined on the closer side or the far side.

Incidentally, when a pair of imaging devices consisting of the first imaging device and the second imaging device are installed as in the experiment described above, the difference between the image positions of the detected object changes uniformly or nearly uniformly in proportion to the actual movement of the detected object locations that are spaced apart from the intersection of the optical axes by 10 mm or more as shown in FIGS. 11 and 12. Thus, the position of the detected object with respect to the reference position can be determined reliably or nearly reliably by setting the set distance to be 10 mm.

Accordingly, an automated roll transport facility is provided in which the position of the detected object, which is at least the device side support element, can be determined precisely.

In the embodiment of the present invention, learning means is preferably provided for learning a correspondence relationship between a difference between the image positions of the learning purpose detected object in a pair of images captured by the first imaging device and second imaging device, and the position of the learning purpose detected object in the depth-wise direction, based: on a difference of image positions of the learning purpose detected object in a pair of images captured by the first imaging device and the second imaging device when the learning purpose detected object is located in a first detection location that is located within the detecting range and between the first imaging device and the second imaging device in a direction that extends along the first imaginary line; on a difference of image positions of the learning purpose detected object in a pair of images captured by the first imaging device and the second imaging device when the learning purpose detected object is located in a second detection location that is located within the detecting range and between the first imaging device and the second imaging device in a direction that extends along the first imaginary line and that is displaced from the first detection location in the depth-wise direction; and on positions of the first detection location and the second detection location in the depth-wise direction, wherein the determination means is preferably configured to determine the position of the detected object within the detecting range and with respect to the reference position in the depth-wise direction based on the difference between the image positions of the detected object in the pair of images captured by the first imaging device and the second imaging device and on the correspondence relationship learned by the learning means.

That is, learning means first learns the correspondence relationship of the difference of the image positions of the learning purpose detected object in the pair of images captured by the pair of imaging devices consisting of the first imaging device and the second imaging device, as the difference corresponds to the depth-wise direction of the learning purpose detected object.

In this learning, when the image of the learning purpose detected object located at the first detection location is captured by the pair of imaging devices, the difference between the position of the learning purpose detected object in the image captured by one imaging device and the position of the learning purpose detected object in the image captured in the other image device is obtained as the parallax for the first detection location. Similarly, when the image of the learning purpose detected object located at the second detection location is captured by the pair of imaging devices, the difference between the position of the learning purpose detected object in the images captured by one imaging device and the position of the learning purpose detected object in the image captured in the other image device is obtained as the parallax for the second detection location.

And the correspondence relationship, between the position of the learning purpose detected object in the depth-wise direction and the difference between the image positions of the learning purpose detected object in the pair of images captured by the pair of imaging devices, is learned based on the parallax for the first imaging location and the position of the first detection location in the depth-wise direction as well as the parallax for the second imaging location and the position of the second detection location in the depth-wise direction.

By way of describing more about this learning process, in the experiment described above, when the detected object is moved at the locations that are spaced apart from the intersection of the optical axes by a large distance toward the closer side or toward the far side, the difference between the image positions of the detected object changes by the same or approximately the same amount if the amount of the actual movement of the detected object is the same. In addition, even if the distance from the intersection o of the optical axes of the imaging devices is changed or if the intersecting angles of the optical axes, etc. are changed from the conditions in the experiment described above, when the detected object is moved at the locations that are spaced apart from the intersection of the optical axes by a large distance toward the closer side or toward the far side, the difference of the image positions of the detected object changes by the same or approximately the same amount if the amount of the actual movement of the detected object is the same as shown, for example, in FIG. 21. Therefore, as shown, for example, in FIG. 23, the correspondence relationship between the position of the learning purpose detected object in the depth-wise direction and the difference between the image positions of the learning purpose detected object in the pair of images captured by the pair of imaging devices can be learned based on the difference of the positions of the learning purpose detected object in the pair of images and the positions of a plurality of locations, such as the first detection location and the second detection location, in the depth-wise direction.

And by learning the correspondence relationship as shown, for example, in FIG. 23, with the learning means in this manner, the determination means can determine the position of the detected object in the depth-wise direction with respect to the reference position by capturing the image of the detected object with the pair of imaging devices and based on the difference between the position of the detected object in the image captured by one imaging device and the position of the detected object in the image captured by the other imaging device.

When the position of the detected object is determined by triangulation, the installation of the imaging devices requires extra time and efforts because it is necessary to provide to the determination means information on the installation position of the pair of imaging devices consisting of the first imaging device and the second imaging device and information on the installation angles, etc., and to install the pair-of imaging devices with sufficient accuracy so as to have this installation positions and installation angle that are provided. However, with the configuration above, installation of the imaging devices is facilitated by learning the relationship between the position of the learning purpose detected object in the depth-wise direction and the difference between the image positions of the learning purpose detected object in the pair of images captured by the pair of imaging devices, because the position of the detected object can be determined from the relationship obtained by learning even if the accuracy in mounting the imaging devices is somewhat low.

In an embodiment of the invention, the determination means is preferably configured to define a non-detecting range to be a range whose distance from the intersection of the optical axes is less than the set distance and which is defined on a far side of the intersection of the optical axes, and to define a detecting range to be a range whose distance from the intersection of the optical axes is greater than or equal to the set distance and which is defined on a closer side of the intersection of the optical axes, and to determine the position of the detected object in the detecting range with respect to the reference position in the depth-wise direction based on image information captured by the first imaging device and the second imaging device.

That is, when the pair of imaging devices are installed in the manner as in the experiment described above, as shown in FIGS. 11 and 12, at locations that are spaced apart from the intersection of the optical axes by 10 mm or more, the difference between the image positions of the detected object changes more uniformly on the closer side of the intersection of the optical axes, in proportion to the actual movement of the detected object, than on the far side of the intersection. Therefore, the position of the detected object with respect to the reference position in the depth-wise direction can be determined more precisely by the determination means by defining the detecting range, in which the position of the detected object with respect to the reference position in the depth-wise direction is determined by the determination means, to be a range which is on the closer side of the intersection of the optical axes and whose distance is greater than the set distance from the intersection of the optical axes.

In an embodiment of the invention, it is preferable that the first imaging device and the second imaging device are separately located at locations at which their distances from the intersection of the optical axes are equal to each other and at which intersecting angles of the optical axes with line segments that are parallel to the depth-wise direction are equal to each other.

That is, by separately locating the pair of imaging devices consisting of the first imaging device and the second imaging device at locations such that their distance from the intersection of the optical axes is equal and such that the intersecting angles with line segments that are parallel to the depth-wise direction are equal to each other, the process for determining the position of the detected object with the determination means can be simplified by using the same installation requirements such as the distance from the intersection of the optical axes and the intersecting angles with the line segments for the pair of imaging devices.

In the embodiment of the present invention, the determination means is configured: to determine positions of both edges of the detected object in a direction corresponding to the depth-wise direction in each of a pair of images captured by the first imaging device and the second imaging device; to obtain a center position of the detected object in a direction corresponding to the depth-wise direction from the positions of the both ends of the detected object; and to determine a position of the detected object in the detecting range with respect to the reference position in the depth-wise direction based on a difference between the center positions of the detected object in the pair of images.

That is, the positions of both edges of the detected object in the direction corresponding to the depth-wise direction is detected in each of the pair of images captured by the pair of imaging devices consisting of the first imaging device and the second imaging device. And the center position of the detected object in the direction corresponding to the lateral direction is obtained in each of the pair of images from the positions of both edges of the detected object. And the position of the detected object with respect to the reference position in the depth-wise direction is obtained based on the difference between the center positions of the detected object in the pair of images. Therefore, the position of the detected object can be determined so that there would be only a small error.

More specifically, for example, it is possible or conceivable to determine the position of the detected object with respect to the reference position in the depth-wise direction based on the difference of the edge positions of the detected object in the pair of images by detecting the position of one edge of the detected object in the direction corresponding to the depth-wise direction in each of the pair of images captured by the first imaging device and the second imaging device. However, when the position of the detected object is determined in this manner, if the position that is displaced from the edge of the detected object in the image is incorrectly detected as the edge of the detected object, the position of the detected object to be determined would also be determined to be similarly displaced. However, as described above, by determining the position of the detected object with respect to the reference position in the depth-wise direction based on the difference of the center positions of the detected object in the pair of images, even if the position that is displaced from the edge of the detected object in the image is incorrectly detected as the edge of the detected object, the error of the detected position of the detected object is reduced by half, by determining the position of the detected object to be the center position between the incorrectly detected edge of the detected object and other edge of the detected object that is accurately detected. Therefore, the position of the detected object can be determined so that there would be only a small error.

In the embodiment of the present invention, the determination means is preferably configured to determine a position of the detected object with respect to the reference position in a direction parallel to the first imaginary line or in a direction that is perpendicular to the depth-wise direction and to the direction parallel to the first imaginary line, in addition to along the depth-wise direction based on image information captured by the first imaging device and the second imaging device.

That is, the determination means can determine the position of the detected object with respect to the reference position in two dimensions, from the position in two directions consisting of the depth-wise direction and the direction along the first imaginary line, or the position in two directions consisting of the depth-wise direction and a direction that is perpendicular to both the depth-wise direction and the direction along the first imaginary line. In addition, the determination means can determine the position of the detected object with respect to the reference position in three dimensions, from the position in three directions consisting of the depth-wise direction, the direction along the first imaginary line, and a direction that is perpendicular to both the depth-wise direction and the direction along the first imaginary line.

MODES FOR CARRYING OUT THE INVENTION

While a number of embodiments are described hereinafter, any combination of a feature in one embodiment and another feature in another embodiment also falls within the scope of the present invention.

First Embodiment

An embodiment of an automated roll transport facility in accordance with the present invention is described next with reference to the drawings.

Figure 1:
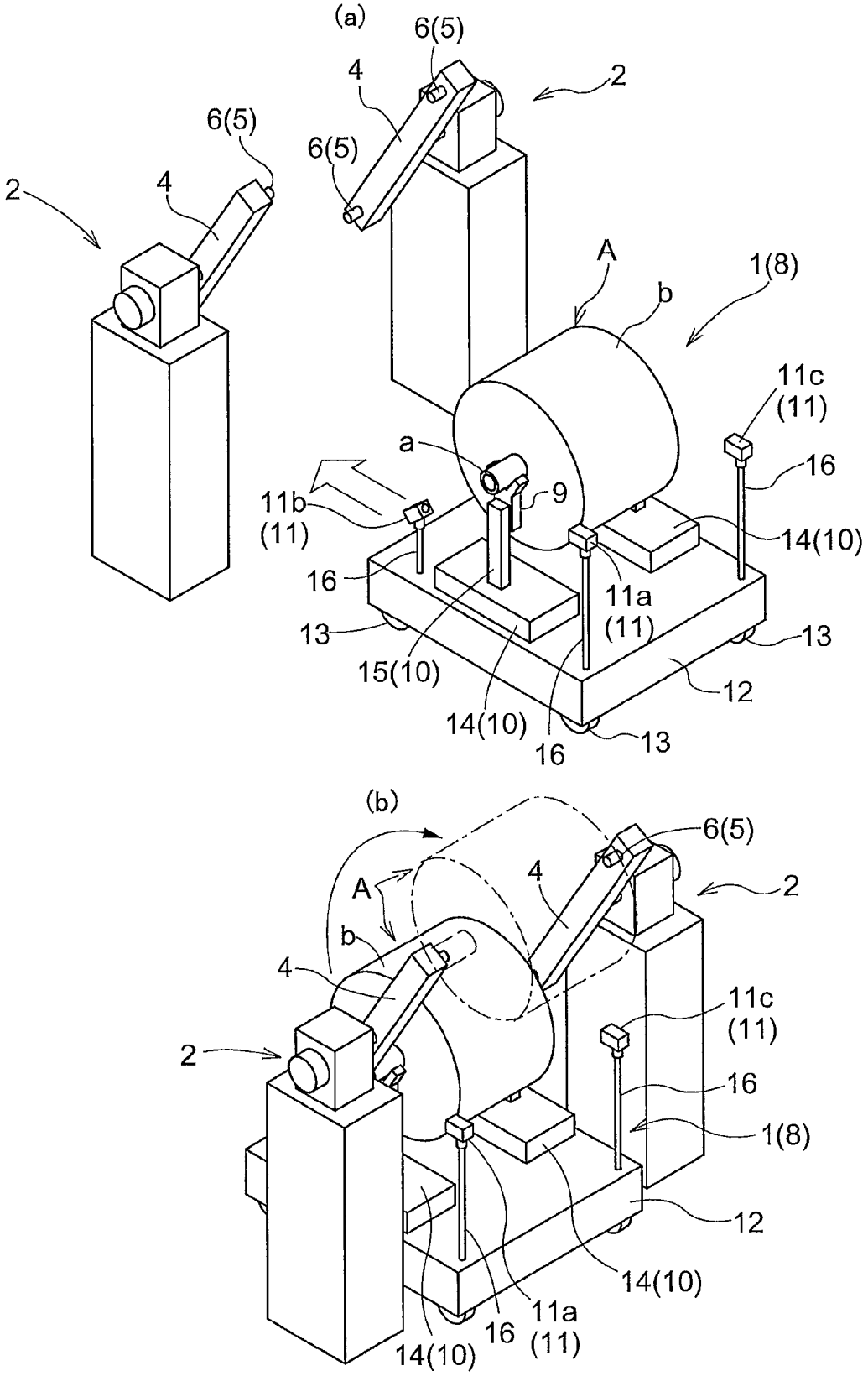
FIG. 1 is a perspective view of a transport carriage.
Figure 2:
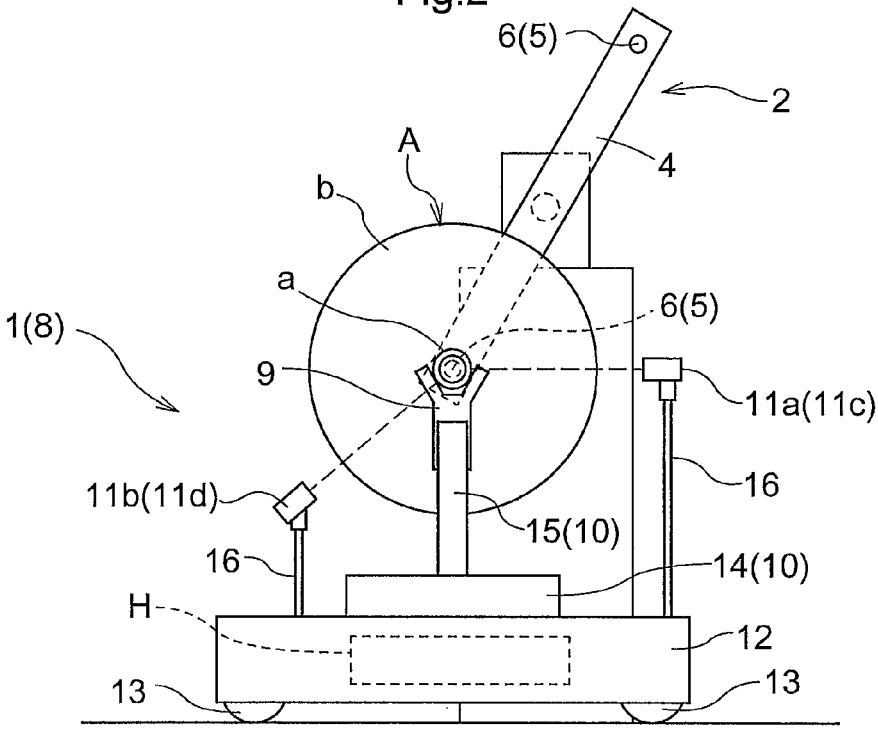
FIG. 2 is a side view of the transport carriage.
Figure 3:
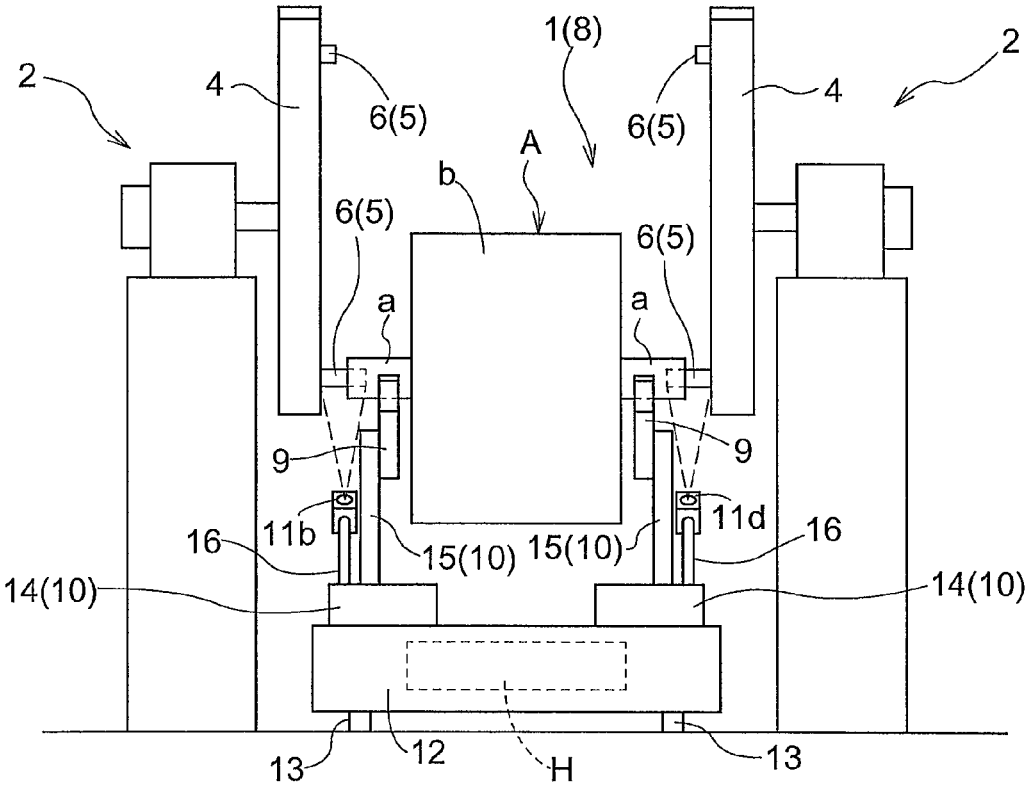
FIG. 3 is a straight forward view of the transport carriage.

As shown in FIG. 1-FIG. 3, the production facility includes, among other things, an automated roll transport vehicle 1 and a chucking device 2 that functions as a receiving device. The chucking device 2 (grip device) is provided to a production machine etc. that performs printing and spraying on the surfaces of printing stencil paper or various film originals. The automated roll transport vehicle 1 is provided in the production facility to transfer rolls A to the chucking device 2, and is configured to travel automatically to a transfer location along a guiding line provided on the floor and to transfer the roll A to the chucking device 2 at a transfer location.

Incidentally, the travel to the transfer location for the automated roll transport vehicle 1 is done by moving forward in the direction shown by the arrow in FIG. 1. In addition, a roll A includes a core and sheet material b such as paper or a film, etc. spooled on the core. The core a located at the center of the roll A projects to both sides along the axial direction from sheet material b.

The chucking device 2 of the production facility is described before describing the automated roll transport vehicle 1.

The chucking device 2 of the production facility includes a pair of rotary arms 4 which can be rotated about pivot axes located at the center in their lengthwise direction, and supports 5 that support the roll A and that rotate and move integrally with the rotary arms 4. Each of the pair of rotary arms 4 has a support pin 6 supported at each end in the longitudinal direction as the support 5. Therefore, each of the pair of rotary arms 4 includes the support pins 6 that functions as a pair of device side support elements. The supports 5 are configured to support the roll A by supporting both ends of the core a individually with each of the pair of support pins 6. In addition, the position of the support 5 (the pair of support pins 6) is switched between a receiving position (the lower left position with respect to the pivot axis of the rotary arms 4 in FIG. 2) and a processing position (the upper right position with respect to the pivot axis of the rotary arms 4 in FIG. 2) as the rotary arms 4 are rotated and stopped in phase with each other. A roll A is received from the automated roll transport vehicle 1 with the support 5 located in the receiving position, and sheet material b is fed out from the roll A currently supported with the support 5 located in the processing position. And printing or spraying operations, etc. is performed on the sheet material b by the production machine.

Therefore, the support pins 6 are provided at each of both ends in the longitudinal direction of the rotary arm 4; thus, a pair of supports 5 are provided such that when one support 5 is located in the receiving position, the other support 5 is located in the processing position.

Figure 4:
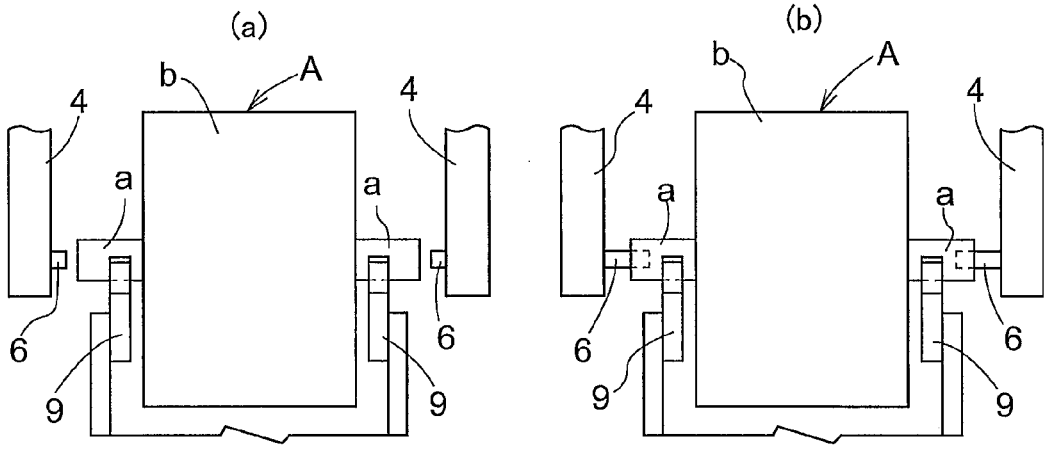
FIG. 4 shows a roll and a pair of device side supports.

As shown in FIG. 4, the pair of support pins 6 that face each other are supported by respective rotary arm 4 such that they can be moved closer toward and away from each other by an operation of an electric motor (not shown). And with the core a located in a proper position at which both ends of the core a can be supported by the pair of support pins 6 and with the support located in the receiving position, both ends of the core a come to be supported by the pair of support pins 6 by moving the support pins 6 from the positions where they are away from each other (see FIG. 4 (*a*)) to positions where they are closer toward each other (FIG. 4 (*b*)). And the support of both ends of the core a by the pair of support pins 6 is released by moving the support pins 6 from the positions where they are closer toward each other to positions where they are away from each other.

The distal end portion of each support pin 6 is formed to have a cylindrical exterior shape whose diameter is smaller than the inside diameter of the core a. And the distal end portions of the support pins 6 are inserted into the core a as the pair of support pins 6 are brought closer to each other. In addition, the distal end portion of the support pin 6 is configured such that its diameter can be increased from its cylindrical shape having a smaller diameter. The ends of the core a are supported by the support pin 6 by increasing the diameters of the distal end portions of the support pins 6 with the distal end portions inserted into the core a.

Incidentally, the direction along which the pair of support pins 6 are moved closer toward and away from each other as well as the direction of the pivot axes of the rotary arms 4 is the same as the direction along which the axis of the core a (axis of the roll A) located in the proper position extends. In addition, the proper position for the core a is, more specifically, a position at which the axis of the pair of support pins 6 and the axis of the core a are in a straight line in the axial direction when the axes of the pair of support pins 6 located in the receiving position are located on a straight line.

The automated roll transport vehicle 1 is described next.

As shown in FIGS. 1-3, the automated roll transport vehicle 1 includes supporting mounts 9 that function as transport vehicle side support elements for supporting the roll A above the transport carriage 8, moving operation means 10 for moving the core a of the roll A supported by the supporting mounts 9 with respect to the transport carriage 8, imaging devices 11 for capturing images of the support pins 6 of the chucking device 2, a control device H that functions as control means for controlling the operation of the moving operation means 10 based on the image information captured by the imaging devices 11, and a carriage main body 12 having travel wheels 13 with all provided to the transport carriage 8. Each of control means, control device, determination means, and operation control means described in this specification has all or some of the components that conventional computers have, such as a CPU, memory, and a communication unit, and has algorithms, that are required to perform the functions described in the present specification, stored in memory. In addition, determination means and braking control means are preferably embodied in algorithms of a control device.

Incidentally, the transport carriage 8 includes the supporting mounts 9, the moving operation means 10, the imaging devices 11, and the control device H all supported on the carriage main body 12.

A pair of supporting mounts 9 are provided and arranged in the vehicle body right and left or lateral direction such as to individually support both ends of the core a projected from sheet material b. An upper end portion of each of the pair of supporting mounts 9 is formed to have a V-shape as seen in a vehicle body right and left or lateral direction. Thus, the supporting mounts 9 are configured to receive and support a roll A fixedly with respect to the supporting mounts 9 by receiving and supporting the ends of the core a in and by the V-shaped upper end portions.

And since the supporting mounts 9 are configured to receive and support the ends of the core a as described above, the distal end portions of the support pins 6 can be inserted laterally into the core a supported by the supporting mounts 9. And the supporting mounts 9 support the roll A such that the roll A can be transferred to the chucking device 2.

The moving operation means 10 includes slide tables 14 that can slide in the vehicle body lateral direction and a vehicle body fore and aft direction with respect to the carriage main body 12, and vertical movement support arms 15 that are provided to fixedly stand erect on the slide tables 14 and that support the supporting mounts 9 in their upper end portions such that the supporting mounts 9 can be moved in the vertical direction. A pair of the vertical movement support arms 15 are provided and arranged in the vehicle body lateral direction such as to individually support the pair of supporting mounts 9 such that the supporting mounts 9 can be vertically moved. And a pair of the slide tables 14 are provided and arranged in the vehicle body lateral direction such as to individually support the pair of vertical movement support arms 15. Each slide table 14 is of the conventional technology and generally includes a table lower portion fixed to the carriage main body 12, a table intermediate portion provided to the table lower portion such as to be movable in the lateral direction with respect to the table lower portion, a table upper portion that is movable in the fore and aft direction with respect to the table intermediate portion. And provided respectively between the table lower portion and the table intermediate portion as well as between the table intermediate portion and the table upper portion are one or more guide rails fixed to one side and guided members guided by the guide rails. In addition, an electric motor connected to the table intermediate portion through a driving force transmitting member, such as a ball screw, a chain, or a gear is provided to move the table intermediate portion with respect to the table lower portion. And an electric motor connected to the table upper portion through a driving force transmitting member, such as a ball screw, a chain, or a gear is provided to move the table upper portion with respect to the table intermediate portion. This is only an example and the slide table 14 is not limited to one having this structure. In addition, as the moving operation means 10, articulated robot arms or any conventional technology for moving a supported object in the vehicle body lateral direction and in the vehicle body fore and aft direction with respect to the carriage main body 12 may be used. Similarly, each vertical movement support arm 15 includes a fixed portion fixed to the slide table 14, and a movable portion which can move in the vertical direction with respect to this fixed portion. And provided between the fixed portion and the movable portion is an electric motor connected through a driving force transmitting member such as a ball screw, a chain, or a gear to one portion to move one portion with respect to the other portion.

Therefore, the moving operation means 10 is configured to be able to move the pair of vertical movement support arms 15 and thus the pair of supporting mount 9 in the vehicle body lateral direction and in the vehicle body fore and aft direction by sliding and moving the pair of slide tables 14 in the vehicle body lateral direction and in the vehicle body fore and aft direction, and also to be able to individually move the pair of supporting mounts 9 in the vertical direction with the pair of vertical movement support arms 15.

In this manner, the moving operation means 10 is configured to move the core a by moving the pair of supporting mounts 9. More specifically, the moving operation means 10 is configured to move both ends of the core a in the vertical direction, the vehicle body lateral direction, and in the vehicle body fore and aft direction with respect to the carriage main body 12 by moving the pair of supporting mounts 9 integrally or in unison, while maintaining the posture or attitude of the core a. In addition, the moving operation means 10 is configured to individually move the ends of the core a in the vertical direction, the vehicle body lateral direction, and in the vehicle body fore and aft direction with respect to the carriage main body 12 in order to change the posture or attitude of the core a by individually moving the pair of supporting mounts 9 in the vertical direction, the vehicle body lateral direction, and in the vehicle body fore and aft direction.

The imaging devices 11 are provided to the carriage main body 12 such that a support pin 6 and the core a are simultaneously captured in one field of view of a imaging device 11 with the transport carriage 8 stopped at a transfer location. The imaging device or imaging means includes a photoelectric conversion element, such as a CCD image sensor, a CMOS image sensor, and an Organic Photoconductive Films (OPC), and a function to transmit image data to a control device etc., And an imaging device that is of a conventional technology, including a camera can be used for such device or means.

And provided as the imaging devices 11 are a total of four imaging devices 11 provided on the carriage main body 12 including a one side straight forward view imaging device 11*a* and a one side angular view imaging device 11*b* for capturing one of the pair of support pins 6 and one end of the core a with the transport carriage 8 stopped at the transfer location, and the other side front imaging device 11*c* and the other side angular view imaging device 11*d* for capturing the other of the pair of support pins 6 and the other end of the core a with the transport carriage 8 stopped at the transfer location.

Each of these four imaging devices 11 is supported by an upper end portion of a support bar 16 fixedly arranged vertically on the carriage main body 12 such that the height and the direction of the imaging device 11 can be adjusted.

The pair including the one side straight forward view imaging device (first imaging device) 11*a* and the one side angular view imaging device (second imaging device) 11*b* as well as the pair including the other side straight forward view imaging device (third imaging device) 11*c* and the other side angular view imaging devices (fourth imaging device) 11*d* are positioned such that their respective imaging directions intersect as seen in the direction along the axis of the core a.

Incidentally, the one side straight forward view imaging device 11*a* and the one side angular view imaging device 11*b* correspond to a one side imaging device, and the other side straight forward view imaging device 11*c* and the other side angular view imaging device 11*d* correspond to the other side imaging device. In addition, the axial direction as used in the expression "as seen in the axial direction of the core a" means an axial direction of the core a that is located in a proper position corresponding to the pair of support pins 6 located in the receiving position, and is the same direction as the vehicle body lateral direction or the right and left direction with the transport carriage 8 stopped at the transfer location.

As shown in FIGS. 1-3, the one side straight forward view imaging device 11*a* is provided to the rear of one end side, in the vehicle body lateral direction, of the carriage main body 12 such that it is located rearwardly of the core a which is moved by the moving operation means 10, is at a height within the vertical movement range of the core a moved by the moving operation means 10, and is located outwardly in the vehicle body lateral direction with respect to the supporting mount 9 on the one side. And, the one side angular view imaging device 11*b* is provided to the front of the one end side, in the vehicle body lateral direction, of the carriage main body 12 such that it is located forwardly and downwardly of the core a moved by the moving operation means 10 and is located outwardly in the vehicle body lateral direction with respect to the supporting mount 9 on the one side. In addition, the other side straight forward view imaging device 11*c* is provided to the rear of the other end side, in the vehicle body lateral direction, of the carriage main body 12 such that it is located rearwardly of the core a which is moved by the moving operation means 10, is at a height within the vertical movement range of the core a moved by the moving operation means 10, and is located outwardly in the vehicle body lateral direction with respect to the supporting mount 9 on the other side. And, the other side angular view imaging device 11*d* is provided to the front of the other end side, in the vehicle body lateral direction, of the carriage main body 12 such that it is located forwardly and downwardly of the core a moved by the moving operation means 10 and is located outwardly in the vehicle body lateral direction with respect to the supporting mount 9 on the other side.

And the one side straight forward view imaging device 11*a* and the other side straight forward view imaging device 11*c* are arranged to have their attitudes such that their imaging directions are directed horizontally and forwardly. The one side angular view imaging device 11*b* and other side angular view imaging device 11*d* are arranged to have their attitudes such that their imaging directions are directed upwardly and rearwardly.

In addition, the one side straight forward view imaging device 11*a* and the one side angular view imaging device 11*b* are configured to capture images of the distal end portion of the support pin 6 on the one side located in the receiving position and one end portion of the core a in the proper position with the transport carriage 8 stopped at the transfer location. the other side straight forward view imaging device 11*c* and the other side angular view imaging device 11*d* are configured to capture images of the distal end portion of the support pin 6 on the other side located in the receiving position and the other end portion of the core a in the proper position with the transport carriage 8 stopped at the transfer location.

Figure 5:
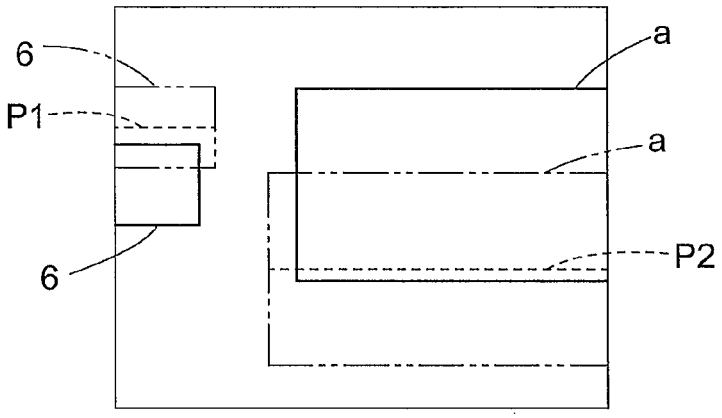
FIG. 5 shows a straight forward view image captured by a straight forward view imaging device of the first embodiment.
Figure 6:
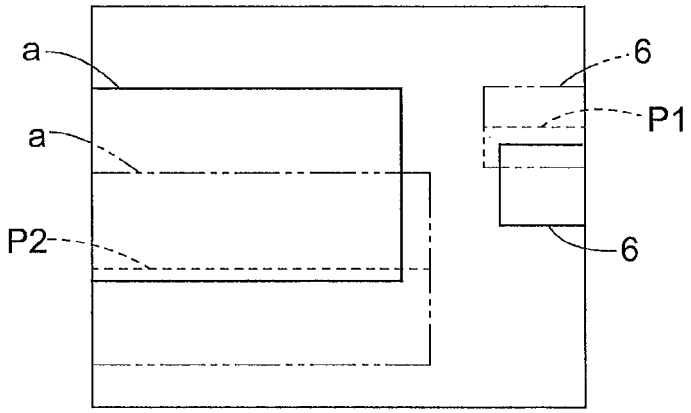
FIG. 6 shows an angular image captured by an angular view imaging device of the first embodiment.

Incidentally, FIG. 5 shows an image captured by the one side straight forward view imaging device 11*a* while FIG. 6 shows an image captured by the one side angular view imaging device 11*b*.

To describe in more detail about the imaging of the support pin 6 by the one side straight forward view imaging device 11*a* and the one side angular view imaging device 11*b*, by capturing the images when the support pin 6 on the one side is located in the receiving position and the transport carriage 8 is stopped at the transfer location, an image of the distal end portion of the support pin 6 on the one side is captured as having a proper size and in a proper position in the image captured by the one side straight forward view imaging device 11*a* (referred to hereafter as the straight forward view image) and in the image captured by the one side angular view imaging device 11*b* (referred to hereafter as the angular view image) as shown in FIGS. 5 and 6 with solid lines.

And when the support pin 6 on the one side and the transport carriage 8 are displaced relative to each other in the vertical direction or in the vehicle body lateral direction, because, among other reasons, the support pin 6 on the one side is displaced from the receiving position, or the transport carriage 8 is stopped at a location that is deviated from the transfer location, or because the core a is supported by the supporting mount 9 in a position that is displaced from the proper support position due to vibration during the transportation, then an image of the distal end portion of the support pin 6 on the one side is captured in which it is displaced from the proper position in the vertical direction in the image or in the lateral direction in the image in the straight forward view image and in the angular view image as shown in FIGS. 5 and 6 with imaginary lines. And when the support pin 6 on the one side and the transport carriage 8 are displaced relative to each other in the vehicle body fore and aft direction, an image of the distal end portion of the support pin 6 on the one side is captured as having a smaller or larger size than the proper size in the straight forward view image and in the angular view image.

And to describe in more detail about the imaging of the one end portion of the core a by the one side straight forward view imaging device 11*a* and by the one side angular view imaging device 11*b*, when the support pin 6 on the one side is located in the receiving position and the transport carriage 8 is stopped at the transfer location and the core a is located at the proper position, an image of the one end portion of the core a is captured as being in the proper position a' and having a proper size in the straight forward view image and in the angular view image as shown in FIGS. 5 and 6 with solid lines.

And when the proper position of the core a is displaced in the vertical direction or in the vehicle body lateral direction with respect to the transport carriage 8 because the position of the core a is displaced from the proper position in the vertical direction or in the vehicle body lateral direction, or because the support pin 6 on the one side and the transport carriage 8 are displaced relative to each other in the vertical direction or in the vehicle body lateral direction although the core a is located in the proper position, then the image of the one end portion of the core a is captured as being displaced from a proper position in the image vertical direction or in the image lateral direction in the straight forward view image and in the angular view image shown in FIGS. 5 and 6 with imaginary lines. And when the core a is displaced from the proper position in the vehicle body fore and aft direction or when the proper position of the core a is displaced in the vehicle body fore and aft direction with respect to the transport carriage 8, the image of one end portion of core a is captured as having a smaller or larger size than the proper size in the straight forward view image and in the angular view image.

Descriptions about the imaging by the other side straight forward view imaging device 11*c* and 11 *d* of other side angular view imaging devices are omitted because the other side straight forward view imaging device 11*c* and the other side angular view imaging device 11*d* capture images of the distal end portion of the support pin 6 on the other side and the other end portion of the core a in the same manner as the one side straight forward view imaging device 11*a* or the one side angular view imaging device 11*b* captures the images of the distal end portion of the support pin 6 on the one side and the one side portion of the core a.

Figure 8:
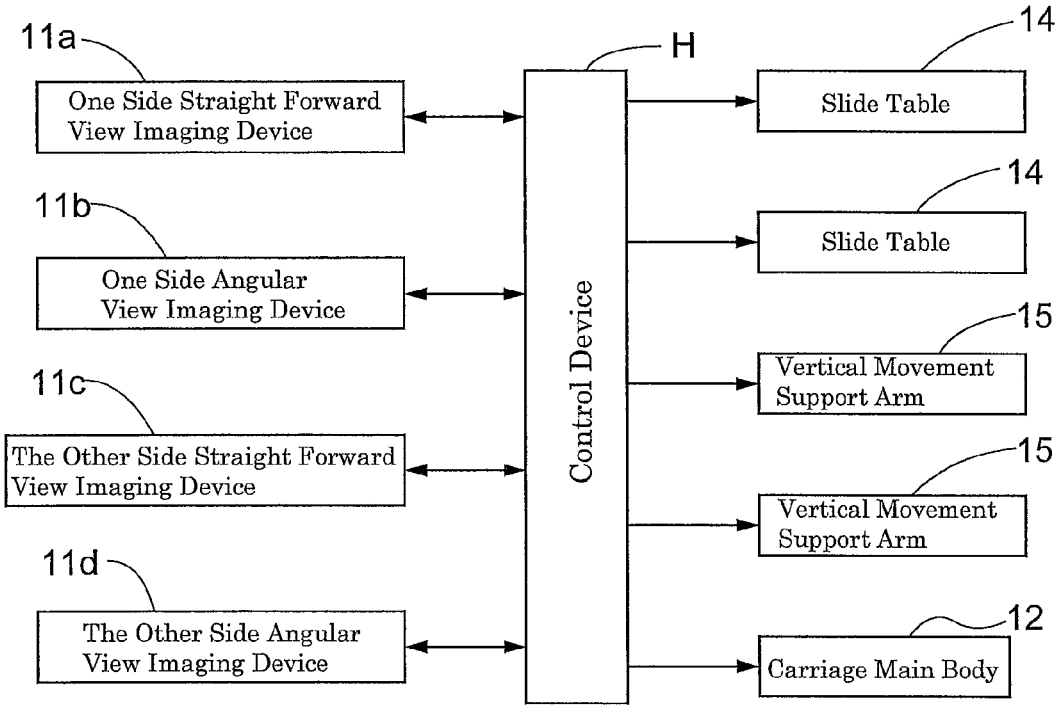
FIG. 8 is a control block diagram of the first embodiment.

The control device H is configured: to control the operation of the carriage main body 12 to cause the transport carriage 8 to travel along the guiding line and to travel automatically to a transfer location; to operate the four imaging devices 11 simultaneously, with the transport carriage 8 stopped at the transfer location, to cause each of the four imaging devices 11 to capture an image of the support pin 6 and the core a such that they are in one field of view, and; to control the operation of the moving operation means 1 to locate the core a in the proper position based on the image information captured by the four imaging devices 11. Incidentally, FIG. 8 is a control block diagram for the automated roll transport vehicle.

Figure 7:
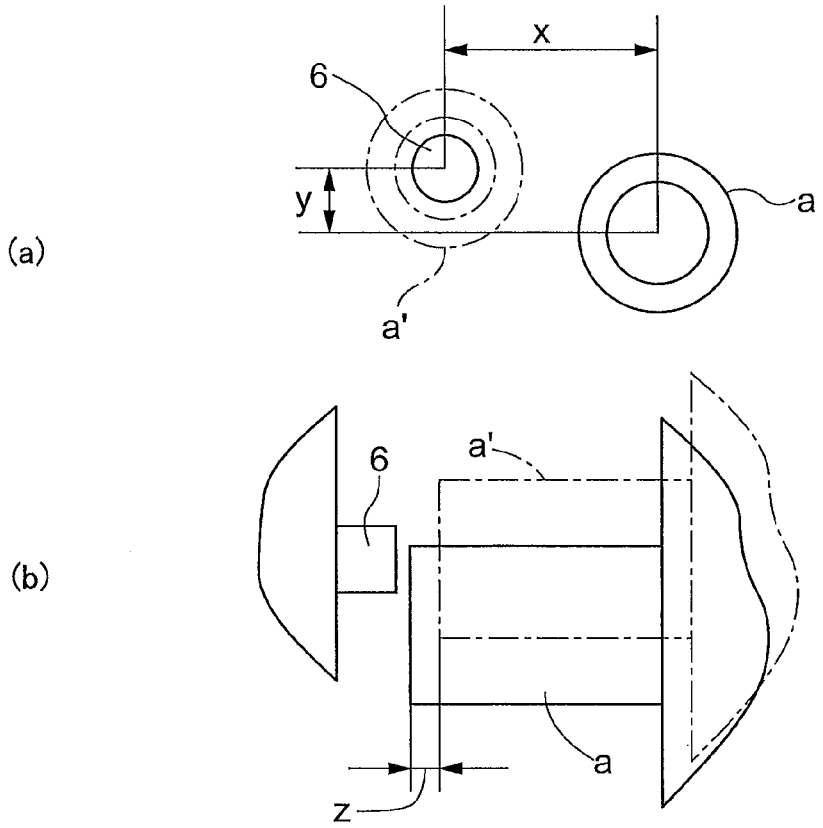
FIG. 7 shows a holding pin and one end of a core in the first embodiment.

The control of the operation of the moving operation means 10 by the control device H described above is described next with reference to FIG. 7. The amount of displacement y of one end portion of the core a in the vertical direction, the amount of displacement z in the vehicle body lateral direction, and the amount of displacement x in the vehicle body fore and aft direction with respect to the one end portion proper position a' are obtained based on the image information captured by the one side straight forward view imaging device 11*a* and the one side angular view imaging device 11*b*. The supporting mount 9 on the one side is then moved in the vertical direction, the vehicle body lateral direction, and in the vehicle body fore and aft direction based on the amounts of displacement x, y, and z of the one end portion of the core a in order to position or to place the one end portion of the core a in the one end portion proper position a'. And the amount of displacement y of the other end portion of the core a in the vertical direction, the amount of displacement z in the vehicle body lateral direction, and the amount of displacement x in the vehicle body fore and aft direction with respect to the other end portion proper position a' are obtained based on the image information captured by the other side straight forward view imaging device 11*c* and the other side angular view imaging device 11*d*. The supporting mount 9 on the other side is then moved in the vertical direction, the vehicle body lateral direction, and in the vehicle body fore and aft direction based on the amounts of displacement x, y, and z of the other end portion of the core a in order to position or to place the other end portion of the core a in the other end portion proper position.

Thus, one end portion of the core a is caused to be located in the one end portion proper position, and the other end portion of the core a is caused to be located in an other end portion proper position so that the core a can be located in the proper position by controlling the operation of the moving operation means 10 by the control device H in this manner.

The amount of displacement in the vertical direction and the amount of displacement x in the vehicle body fore and aft direction of the one end portion of the core a with respect to the one end side proper position a' are obtained as follows.

The location of the axis position P1 of the support pin 6 in the image vertical direction in the straight forward view image is obtained from the upper edge position and the lower edge position of the support pin 6 in the straight forward view image based on the image information captured by the one side straight forward view imaging device 11*a*. And the location of the axis position P1 of the support pin 6 in the image vertical direction in the angular view image is obtained from the upper edge position and the lower edge position of the support pin 6 in angular view image based on the image information captured by the one side angular view imaging device 11*b*. And the position of the axis of the support pin 6 on the one side in the vertical direction and the vehicle body fore and aft direction with respect to the carriage main body 12 is obtained based on the axis position P1 of the support pin 6 in the image vertical direction in the straight forward view image, the axis position P1 of the support pin 6 in the image vertical direction in the angular view image, predetermined intersection angle information between the one side straight forward view imaging device 11*a* and the one side angular view imaging device 11*b*, and on predetermined position information of each of the one side straight forward view imaging device 11*a* and the one side angular view imaging device 11*b*.

And the location of the axis position P2 of the core a in the image vertical direction in the straight forward view image is obtained from the upper edge position and the lower edge position of the core a in the straight forward view image based on the image information captured by the one side straight forward view imaging device 11*a*. And the position of the axis position P2 of the core a in the image vertical direction in the angular view image is obtained from the upper edge position and the lower edge position of the core a in the angular view image based on the image information captured by the one side angular view imaging device 11*b*. And the position of the axis of the one end side of the core a in the vertical direction and the vehicle body fore and aft direction with respect to the carriage 12 is obtained based on the axis position P2 of the core a in the image vertical direction in the straight forward view image, the axis position P2 of the core a in the image vertical direction in the angular view image, and on predetermined intersection angle information.

And based on the axis position P1 of one support pin 6 and the axis position P2 of the one end portion of the core a as obtained above, the amount of displacement y of the one end portion of the core a in the vertical direction and the amount of displacement x in the vehicle body fore and aft direction with respect to the one support pin 6 are obtained; that is, the amount of displacement y of the one end portion of the core a in the vertical direction and the amount of displacement x in the vehicle fore and aft direction, from one end side reference position a' are obtained.

Incidentally, each of the one side straight forward view imaging device 11*a* and the one side angular view imaging device 11*b* is arranged such that its optical axis extends on a vertical plane.

In addition, the amount of displacement z of the one end portion of the core a in the vehicle body lateral direction with respect to one end side proper position a' is obtained as follows.

That is, the position of the support pin 6 in the image lateral direction in the straight forward view image is obtained from the distal end position of the support pin 6 in the straight forward view image based on the image information captured by the one side straight forward view imaging device 11*a*. And the position of the core a in the straight forward view image in the image lateral direction is obtained from the distal end position of the core a in the straight forward view image based on the image information captured by the one side straight forward view imaging device 11*a*. The amount of displacement of the one end portion of the core a in the vehicle body lateral direction with respect to the support pin 6 on the one side is obtained based on the position of the support pin 6 in the straight forward view image in the image lateral direction and on the position of the core a in the straight forward view image in the image lateral direction. From this, the amount of displacement z of the one end portion of the core a from one end side reference position a' in the vehicle body lateral direction is obtained.

Descriptions on how the amounts of displacement of the other end portion of the core a in the vertical direction, the vehicle body lateral direction, and in the vehicle body fore and aft direction with respect to the other end side proper position are obtained are omitted because they are obtained in the same manners as the amounts of displacement x, y, z of the one end portion of the core a in the vertical direction, the vehicle body lateral direction, and in the vehicle body fore and aft direction with respect to the one end side proper position. In addition, each of the other side straight forward view imaging device 11*c* and the other side angular view imaging device 11*d* is arranged such that its optical axis extends along a vertical plane, and such that the angle of intersection between these optical axes of the devices is the same as the angle of intersection between the optical axis of the one side straight forward view imaging device 11*a* and the optical axis of the one side angular view imaging device 11*b*.

And after positioning the core a in the proper position by controlling the operation of the moving operation means 10, the control device H transmits to the chucking device 2 a signal for communicating the completion of preparation for a transfer using communication means (not shown). The chucking device 2, upon reception of the signal for the completion of transfer preparation, moves the pair of support pins 6 located in the receiving position closer toward each other, and thereafter, increases the diameter of the distal end portion of each of the pair of support pins 6, for example, by injecting air to support both ends of the roll A.

Second Embodiment

The second embodiment in accordance with the present invention is described next. In this embodiment, the same reference number is used for the same or similar element as in the first embodiment, and a description of which will be omitted.

Provided as the imaging devices 11 are a pair of imaging devices 11 consisting of the first imaging device 11*a* and the second imaging device 11*b* that capture one of the pair of support pins 6 and the one end portion of the core a, which is the detected object, with the transport carriage 8 stopped at the transfer location and a pair of imaging devices 11 consisting of the third imaging device 11*c* and the fourth imaging device 11*d* that capture the other of the pair of support pins 6 and the other end portion of the core a with the transport carriage 8 stopped at the transfer location. Thus, the carriage main body 12 has two pairs of imaging devices with a total of four imaging devices 11.

And each of the four imaging devices 11 is provided to the carriage main body 12 such that a support pin 6 and the core a are simultaneously captured in one field of view of the imaging device 11 with the transport carriage 8 stopped at a transfer location.

In addition, each of the four imaging devices 11 is supported at an upper end portion of a support bar 16 that stands fixedly and vertically on the carriage main body 12 such that the height and the direction of the imaging device 11 can be adjusted.

Figure 14:
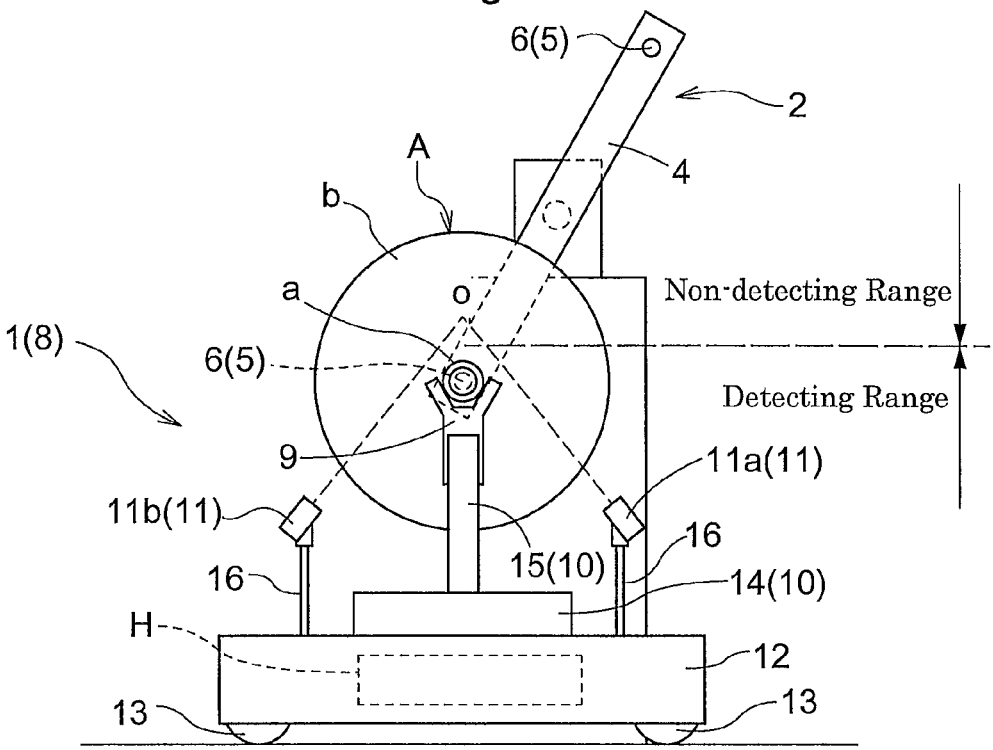
FIG. 14 is a side view of the transport carriage in the second embodiment.
Figure 15:
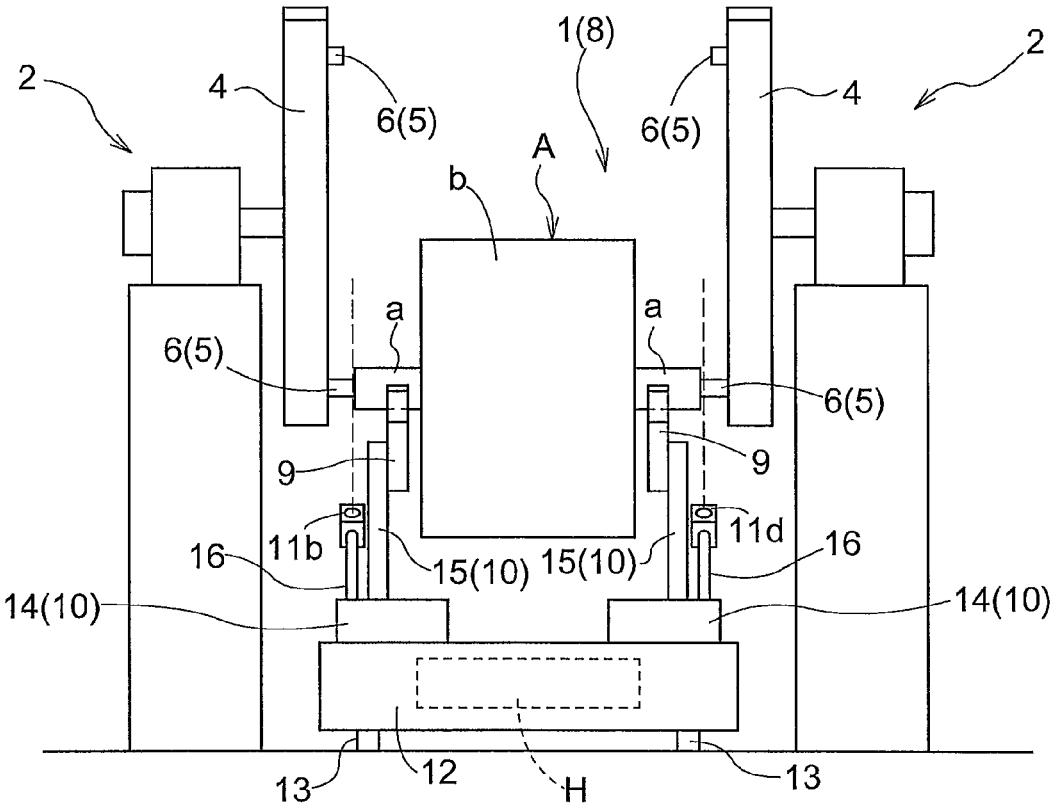
FIG. 15 is a straight forward view of the transport carriage in the second embodiment.

As shown in FIG. 14, the first imaging device 11*a* and the third imaging device 11*c* are installed on the carriage man body 12 such that they are located downwardly and rearwardly of the moving range of the core a moved by the moving operation means 10, and such that they capture images in an upward and forward direction. And the second imaging device 11*b* and the fourth imaging device 11*d* are installed on the carriage man body 12 such that they are located downwardly and forwardly of the moving range of the core a moved by the moving operation means 10, and such that they capture images in an upward and rearward direction.

And the pair of imaging devices 11 consisting of the first imaging device 11*a* and the second imaging device 11*b*: have their optical axes that intersect each other; are located downwardly of the intersection o of the optical axes; and are separately located on either side of the intersection o of the optical axes with respect to the vehicle fore and aft direction.

In addition, the pair of imaging devices 11 consisting of the first imaging device 11*a* and the second imaging device 11*b* are separately located on the same vertical plane as a support pin 6 and their optical axes are located on that vertical plane such that the intersecting angles between their optical axes and line segments whose distance from the intersection o of the optical axes is equal and which are parallel to the vertical direction are equal to each other, and such that their height with respect to the carriage main body 12 is the same and their distance from the intersection o of their optical axes is the same in the vehicle fore and aft direction.

Incidentally, in present embodiment, the vertical direction corresponds to the depth-wise direction with the downward side corresponding to the forward side and the upward direction corresponding to the backward side. In addition, the vehicle body fore and aft direction corresponds to the direction along which the first imaginary line of the present invention extends and the vehicle body lateral direction corresponds to a direction that is perpendicular to the depth-wise direction and the direction along which the first imaginary line extends. An optical axis is a straight line that connects the centers of curvature of the lens of the imaging device 11.

Figure 9:
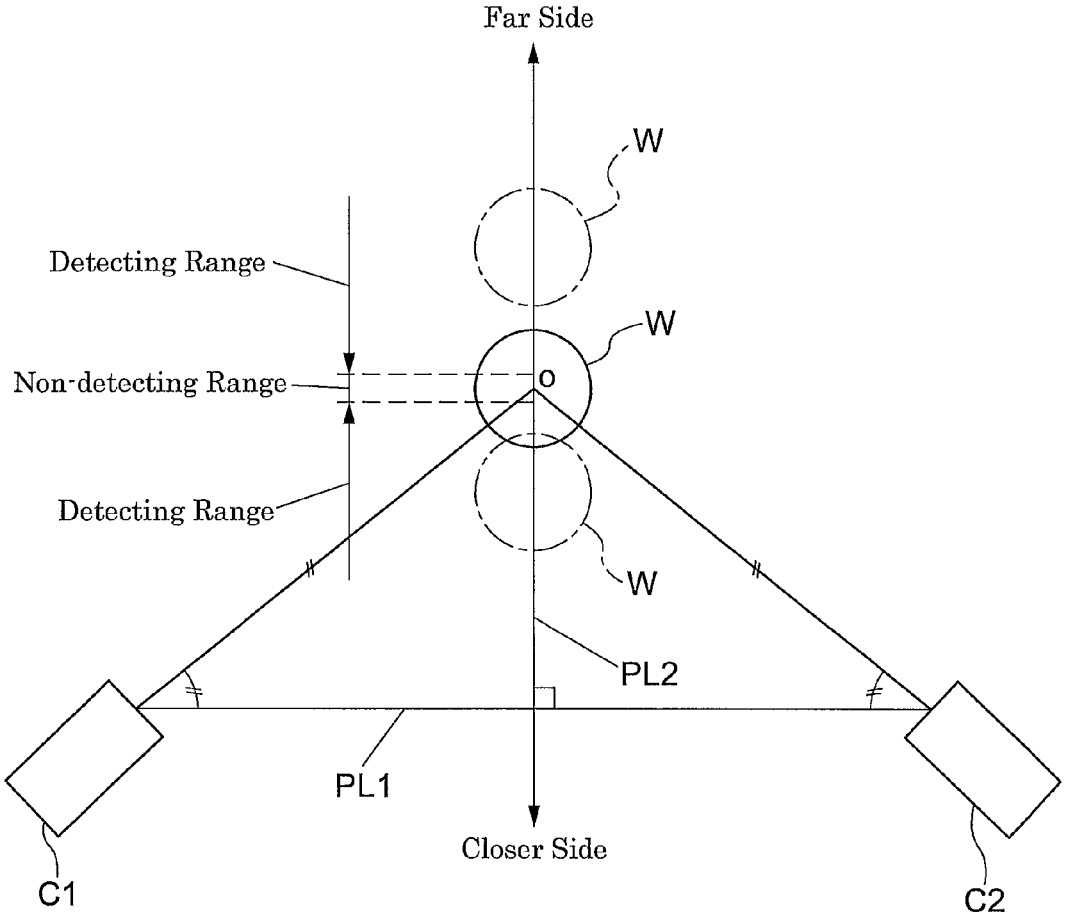
FIG. 9 is a plan view showing the pair of imaging devices and a detected object in an experiment and in the embodiment.
Figure 10:
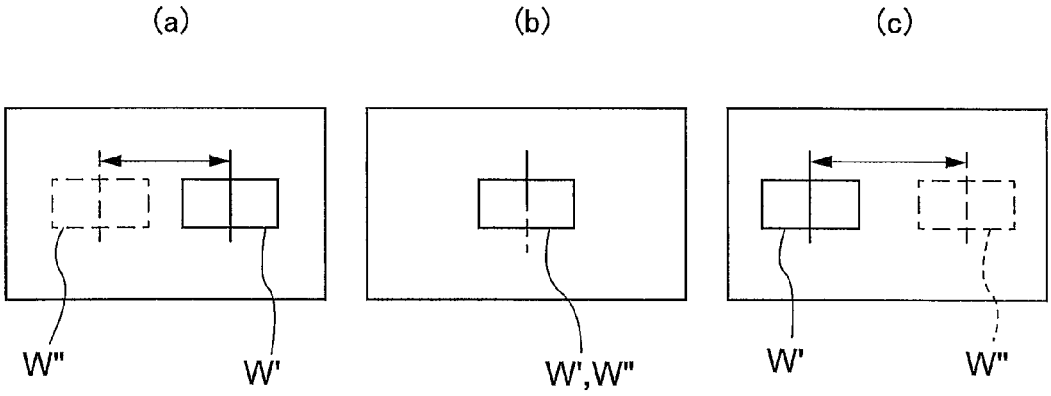
FIG. 10 shows the images captured with the pair of imaging devices in an experiment.
Figure 11:
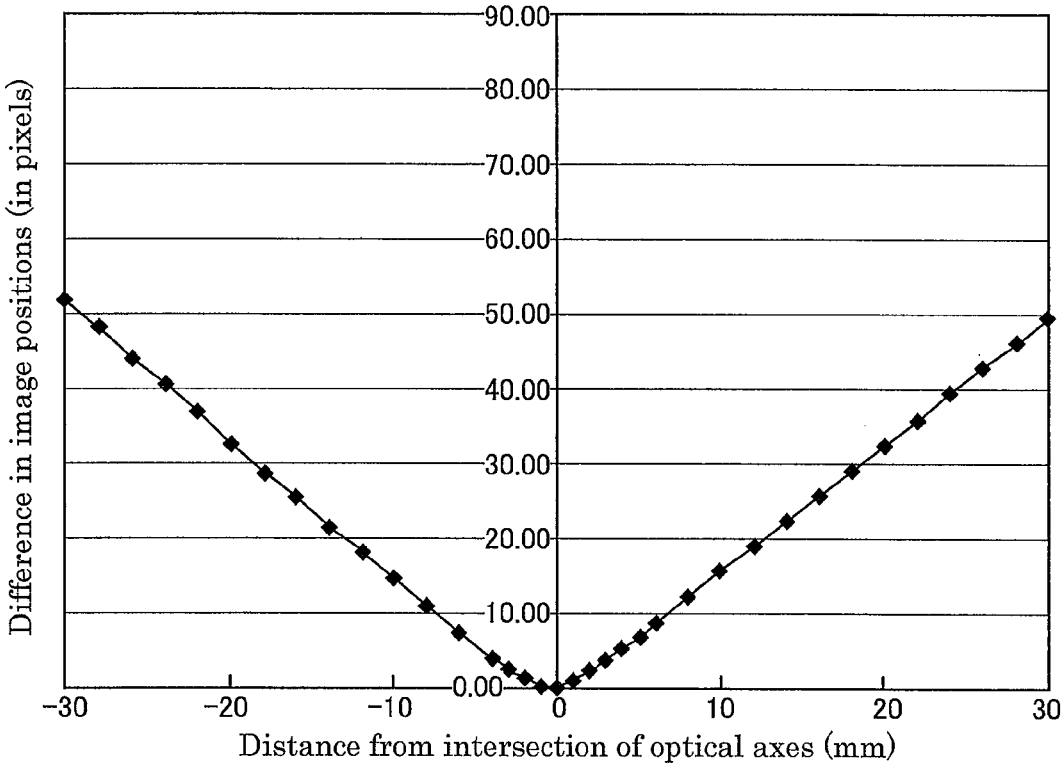
FIG. 11 shows variation in the image positions in the experiment.
Figure 12:
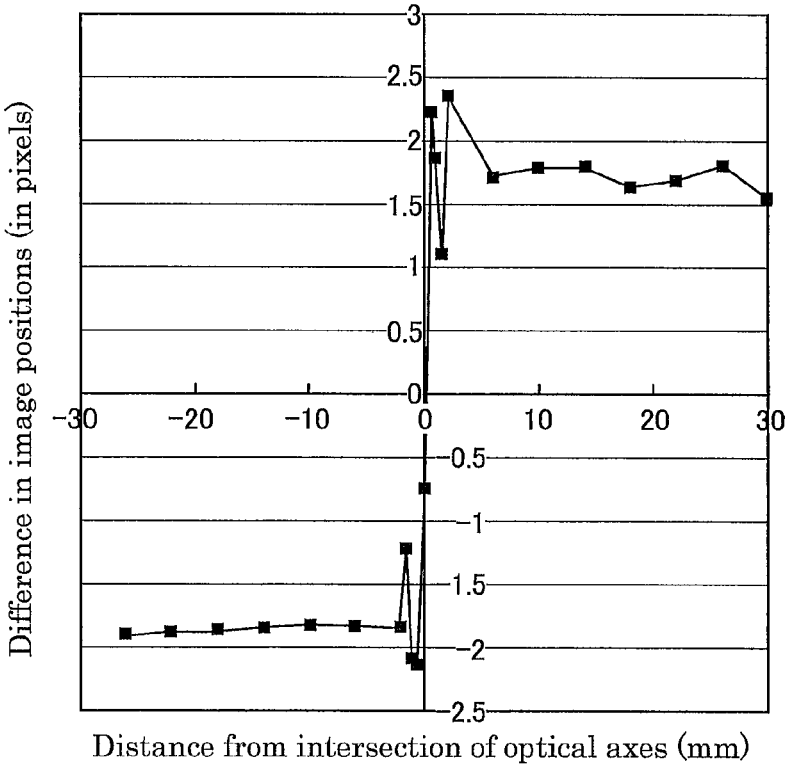
FIG. 12 shows amount changes in the image positions in the experiment.
Figure 13:
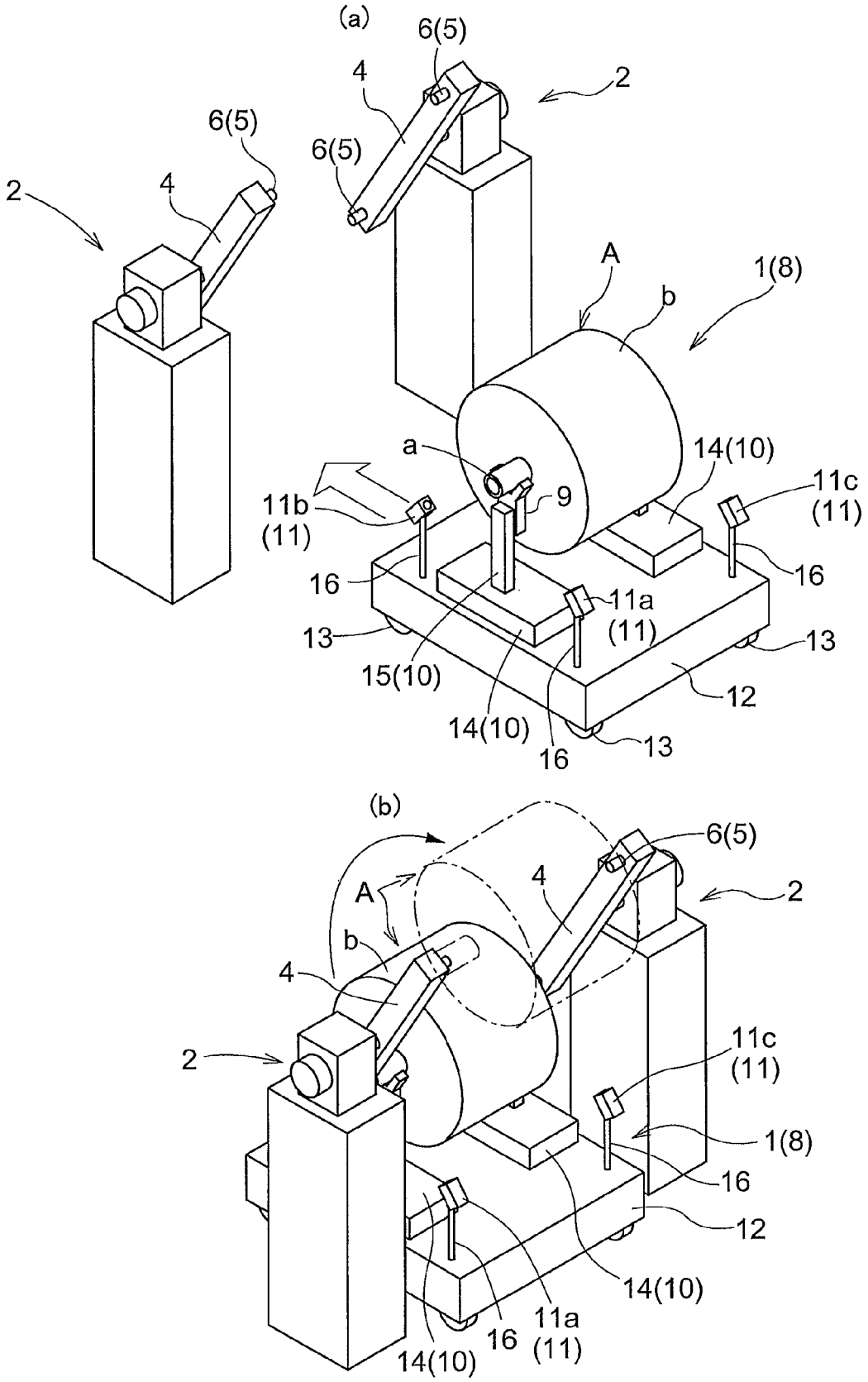
FIG. 13 is a perspective view of a transport carriage in the second embodiment.

In other words, referring to FIG. 9, the depth-wise direction is a direction that extends perpendicular to the first imaginary line PL1 which connects the first imaging device 11*a* (imaging device in the position C1 in FIG. 9) and the second imaging device 11*b* (imaging device in the position C2 in FIG. 9), that extends along the second imaginary line PL2 passing through the intersection of the optical axes, and that points from the closer side toward the far side. This first imaginary line PL1 may be defined as an imaginary line that passes through both the point on the lens surface of one of the imaging devices 11 through which its optical axis passes and the point on the lens surface of the other of the imaging devices 11 through which its optical axis passes. However, the definition for the first imaginary line PL1 is not limited to this. And it may be defined, for example, as a straight line that passes through one point in one of the imaging devices and a point in the other of the imaging devices that is at a corresponding position as said one point. It is further preferable that this straight line lie in the plane that includes the optical axes of the pair of imaging devices.

As shown in FIG. 14, the pair of imaging devices 11 consisting of the first imaging device 11*a* and the second imaging device 11*b* are separately located such that the intersection o of the optical axes is located upwardly of the position where the support pin 6 and the core a exist when the transport carriage 8 is stopped at a transfer location.

That is, although the core a is moved in the vertical direction and in the vehicle body fore and aft direction by the moving operation means 10, the intersection o of the optical axes is located upwardly of this moving range of the core a. In addition, the support pin 6 may be displaced in the vertical direction or in the vehicle body fore and aft direction with respect to the transport carriage 8, because, among other reasons, the support pin 6 is stopped at a location displaced from the receiving position or because the transport carriage 8 is stopped at a location displaced from the transfer location. The intersection o of the optical axes is located upwardly of the range that the support pin 6 is assumed to exist, taking the above displacement into consideration.

In addition the pair of imaging devices 11 consisting of the first imaging device 11*a* and the second imaging device 11*b* are separately located such that the intersection o of the optical axes is located upwardly, by a distance greater than a set distance, of the moving range of the core a and the range in which the support pin 6 is assumed to exist.

Thus, by placing or locating the intersection o of the optical axes, the support pin 6 and the core a are ensured to be located in the detecting range that is located downwardly, in the vertical direction, of the intersection o of the optical axes and that is spaced apart by a distance greater than the set distance from the intersection o of the optical axes. And a range that extends above and below the intersection o of the optical axes in the vertical direction and that is within a set distance from the intersection o of the optical axes is defined to be a non-detecting range. And the support pins 6 and the core a are kept away from this non-detecting range. In addition, a range that is located upwardly of the intersection o of the optical axes in the vertical direction and that is spaced apart by a distance greater than the set distance from the intersection o of the optical axes is also defined to be a non-detecting range. And the support pins 6 and the core a are kept away from this non-detecting range.

Descriptions on the pair of imaging devices 11 consisting of the third imaging device 11*c* and the fourth imaging device 11*d* will be omitted because they are separately located in the same manner as the pair of imaging devices 11 consisting of the first imaging device 11*a* and the second imaging device 11*b*.

The imaging of the support pin 6 by the first imaging device 11*a* and the second imaging device 11*b* is described next.

Figure 17:
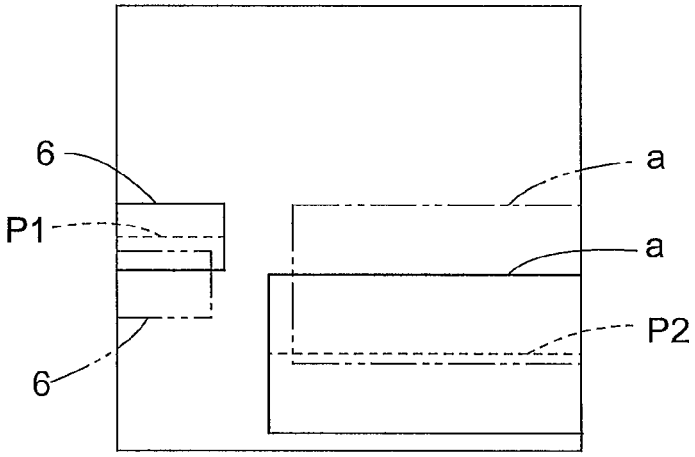
FIG. 17 shows the first image in the second embodiment.
Figure 18:
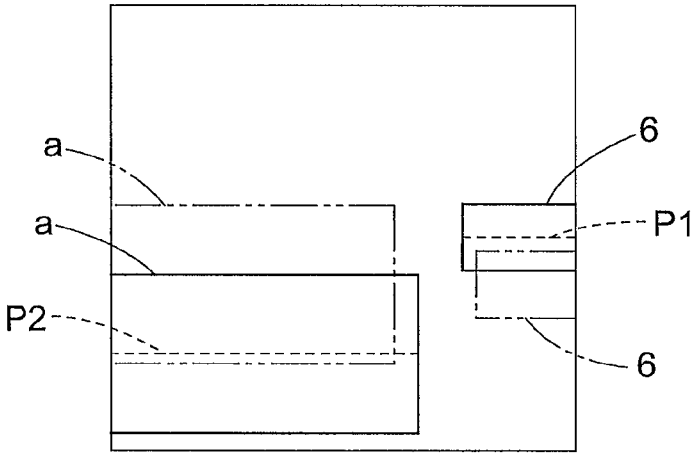
FIG. 18 shows the second image in the second embodiment.

As shown in FIGS. 17 and 18 with imaginary lines, by capturing the images when the support pin 6 on one side is located in the receiving position and the transport carriage 8 is stopped at the transfer location, the image of the distal end portion of the support pin 6 on the one side is captured as being at the proper position in the image captured by the first imaging device 11*a* (referred to hereinafter as the first image), and in the image captured by the second imaging device 11*b* (referred to hereinafter as the second image).

And as shown in FIGS. 17 and 18 with solid lines, when the support pin 6 on the one side and the transport carriage 8 are displaced relative to each other because the support pin 6 on the one side is displaced from the receiving position, or because the transport carriage 8 is stopped at a location that is displaced from the transfer location, or because of other reasons, the image of the distal end portion of the support pin 6 on the one side is captured as being displaced from the proper position in one of or both of the first image and the second image.

In addition, the same is true with the image of the one end portion of the core a as that of the image of the support pin 6 of one side: the image of the one side portion of the core a is captured as being displaced from the proper position in one of or both of the first image and the second image when the one end portion of the core a and the transport carriage 8 are displaced relative to each other because the core a is displaced from the proper support position by the supporting mount 9 due to vibration during transportation or because of other reasons.

Incidentally, FIG. 17 shows the first image captured by the first imaging device 11*a* and FIG. 18 shows the second image captured by the second imaging device 11*b*. And the first and second images are the pair of images captured by the pair of imaging devices 11. If the axis of the support pin 6 was located at the intersection o of the optical axes, the images of the pair of support pins 6 would be captured as being located at the same position in the pair of images.

The control device H includes determination means h1 for determining the positions of the support pin 6 and the core a in the vertical direction, the vehicle body fore and aft direction, and in the vehicle body lateral direction with respect to the transport carriage 8 (more specifically, with respect to the intersection o of the optical axes which is set in advance with respect to the transport carriage 8: the intersection o of the optical axes is the reference position in the present invention) based on the image information captured by the pair of imaging devices 11 consisting of the first imaging device 11*a* and the second imaging device 11*b*, and operation control means h2 for controlling the operation of the moving operation means 10 to locate or place the core a in the proper position based on the positions of the support pin 6 and the core a with respect to the reference position as they are determined by the determination means h1.

In addition, the operation control means h2 is also configured: to control the operation of the carriage main body 12 to cause the transport carriage 8 to travel along the guiding line and to travel automatically to a transfer location; to operate the four imaging devices 11 simultaneously, with the transport carriage 8 stopped at the transfer location, to cause each of the four imaging devices 11 to capture an image of the support pin 6 and the core a such that they are in one field of view, and; to control the operation of the moving operation means 1 to locate the core a in the proper position based on the image information captured by the four imaging devices 11.

Figure 16:
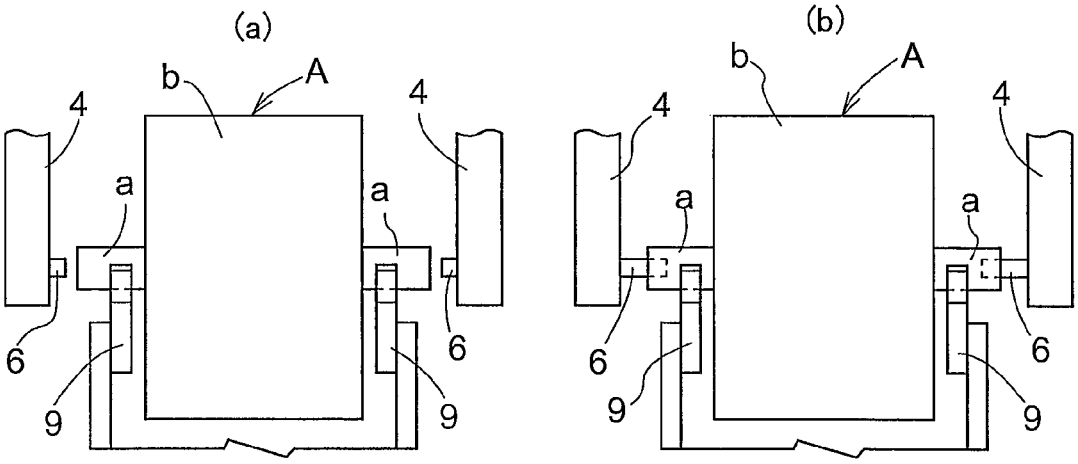
FIG. 16 shows a roll and a pair of device side supports in the second embodiment.

Incidentally, FIG. 16 is a control block diagram of the automated roll transport vehicle.

Determination of the positions of the support pin 6 and the core a by the determination means h1 is described next.

The positions of both the upper edge and the lower edge of the support pin 6 in the first image are detected based on the image information captured by the first imaging device 11*a*. And the position of the axis P1 of the support pin 6 in the image vertical direction in the first image is obtained from the positions of both the upper edge and the lower edge of the support pin 6. In addition, the positions of both the upper edge and the lower edge of the support pin 6 in the second image are detected based on the image information captured by the second imaging device 11*b*. And the position of the axis P1 of the support pin 6 in the image vertical direction in the second image is obtained from the positions of both the upper edge and the lower edge of the support pin 6. And the position of the axis of one of the support pins 6 in the vertical direction and in the vehicle body fore and aft direction with respect to the transport carriage 8 is determined as coordinates with respect to the intersection o of the optical axes, using known position measurement technology for a stereoscopic camera, based on the position of the axis P1 of the support pin 6 in the image vertical direction in the first image, the position of the axis P1 of the support pin 6 in the image vertical direction in the second image, the predetermined intersection angle information between the imaging device 11*a* and the second imaging device 11*b*, and predetermined position information for each of the first imaging device 11*a* and the second imaging device 11*b*. In addition, the axis P1 corresponds to the center position of the support pin 6.

In addition, the positions of both the upper edge and the lower edge of the core a in the first image are detected based on the image information captured by the first imaging device 11*a*. And the position of the axis P2 of the core a in the image vertical direction in the first image is obtained from the positions of both the upper edge and the lower edge of the core a. And the positions of both the upper edge and the lower edge of the core a in the second image are detected based on the image information captured by the second imaging device 11*b*. And the position of the axis P2 of the support pin 6 in the image vertical direction in the second image is obtained from the positions of both the upper edge and the lower edge of the core a. And the position of the axis of one end portion of the core a in the vertical direction and in the vehicle body fore and aft direction with respect to the transport carriage 8 is determined as coordinates with respect to the intersection o of the optical axes, using known position measurement technology for a stereoscopic camera, based on the position of the axis P2 of the core a in the image vertical direction in the first image, the position of the axis P2 of the core a in the image vertical direction in the second image, the predetermined intersection angle information between the imaging device 11*a* and the second imaging device 11*b*, and predetermined position information for each of the first imaging device 11*a* and the second imaging device 11*b*.

Figure 19:
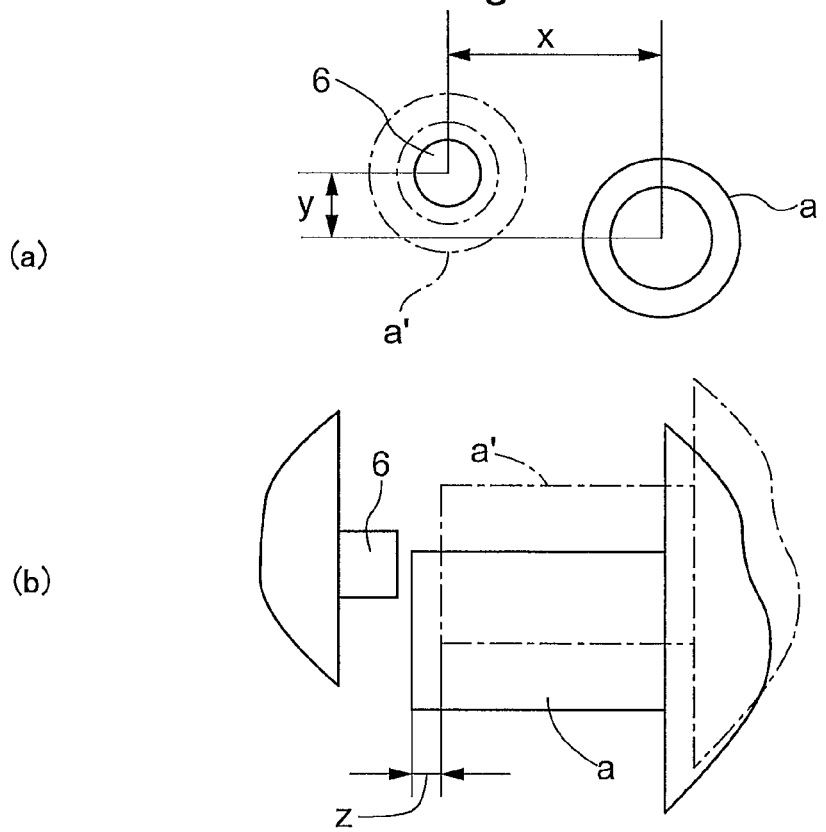
FIG. 19 shows a holding pin and one end of the core in the second embodiment.
Figure 20:
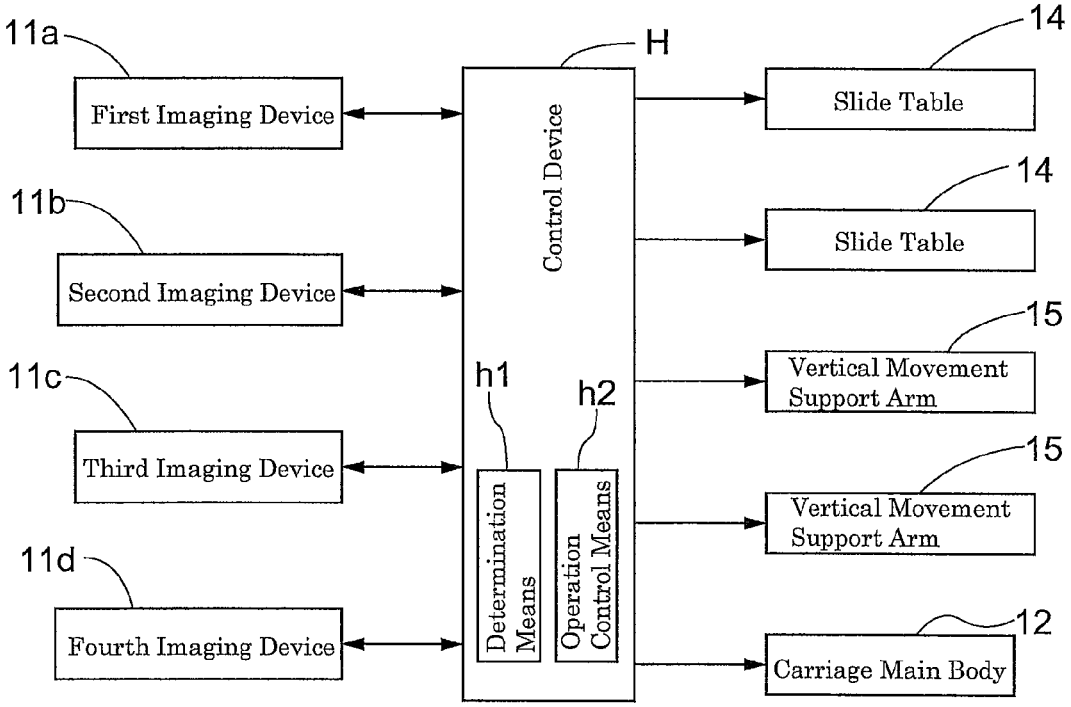
FIG. 20 is a control block diagram of the second embodiment.
Figure 21:
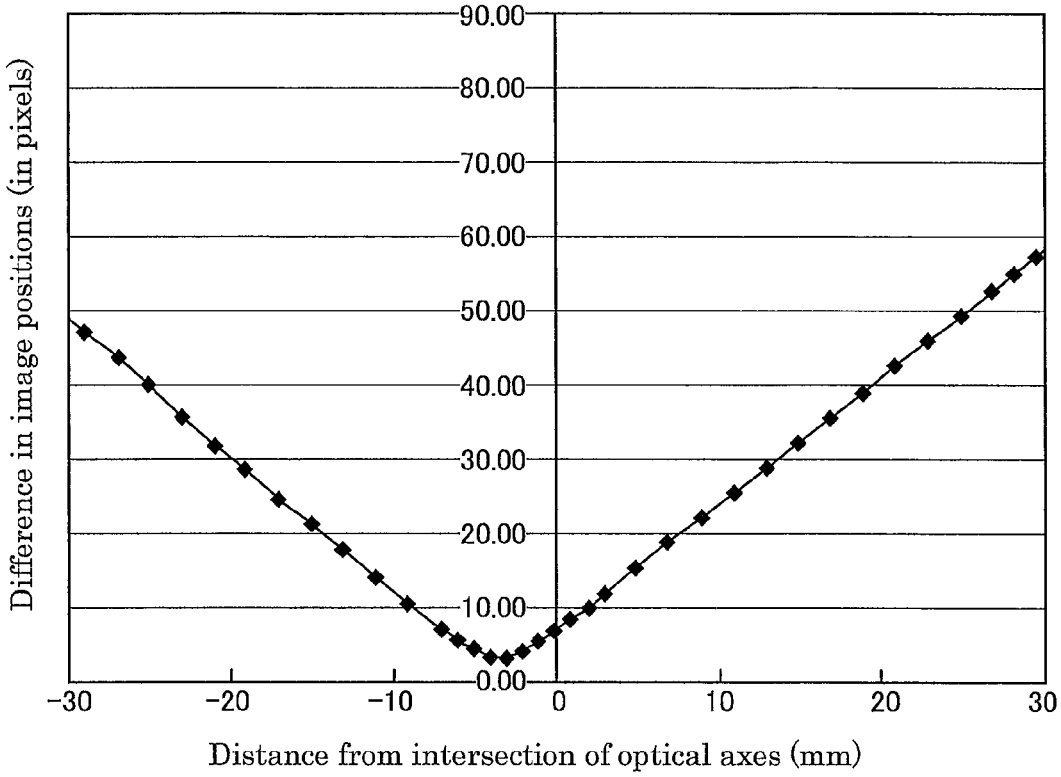
FIG. 21 shows variation in the image positions in the experiment.

And based on the coordinates of the axis of one of the support pins 6 and the coordinates of the axis of one end portion of the core a as obtained above, the amount of displacement y of the one end portion of the core a in the vertical direction and the amount of displacement x in the vehicle body fore and aft direction with respect to the one support pin 6 are obtained; that is, the amount of displacement y of the one end portion of the core a in the vertical direction and the amount of displacement x (see FIG. 19(*a*)) in the vehicle fore and aft direction, from one end side reference position a' are obtained.

And the position of the support pin 6 in the image lateral direction in the first image is obtained from the distal end position of the support pin 6 in the first image based on the image information captured by the first imaging device 11*a*. And the position of the core a in the first image in the image lateral direction is obtained from the distal end position of the core a in the first image based on the image information captured by the first imaging device 11*a*. The amount of displacement of the one end portion of the core a in the vehicle body lateral direction with respect to the one of the support pins 6 is obtained based on the position of the support pin 6 in the image lateral direction in the first image and the position of the core a in the first image in the image lateral direction. And from this, the mount of displacement z of the one end portion of the core a in the vehicle body lateral direction (see FIG. 19 (*b*)) from one end side reference position a' is obtained.

Descriptions on how the amounts of displacement of the other end portion of the core a in the vertical direction, the vehicle body lateral direction, and in the vehicle body fore and aft direction with respect to the other end side proper position are obtained are omitted because they are obtained in the same manners as the amounts of displacement x, y, z of the one end portion of the core a in the vertical direction, the vehicle body lateral direction, and in the vehicle body fore and aft direction with respect to the one end side proper position.

And the operation control means h2 controls the operation of the moving operation means 10 to locate or place the core a in the proper position based on the amounts of displacement x, y, and z obtained from the positions of the support pin 6 and the core a with respect to the traveling carriage as determined by the determination means h1, and then transmits to the chucking device 2 a signal for communicating the completion of preparation for a transfer using communication means (not shown). The chucking device 2, upon reception of the signal for the completion of transfer preparation, moves the pair of support pins 6 located in the receiving position closer toward each other, and thereafter, increases the diameter of the distal end portion of each of the pair of support pins 6, for example, by injecting air to support both ends of the roll A.

In short, because the determination by the determination means h1 of the position of the support pin 6 with respect to the reference position becomes unreliable at or near the intersection o of the optical axes, a set distance is set in order to define the location of the intersection o of the optical axes and its neighboring region, in which determination by the determination means becomes unreliable, as a non-detecting range. And the detecting range is defined to be the range that is located downwardly of the intersection o of the optical axes in the vertical direction, and that is space apart by a distance that is greater than the set distance from the intersection o of the optical axes. And the images of the support pin 6 located in this detecting range are captured by a pair of imaging devices 11, and the position of the support pin 6 from the reference position is determined based on the difference in the image positions of the support pin 6 in the pair of images captured by the pair of imaging devices 11. Thus, the determination of the position of the support pin 6 with respect to the reference position is performed precisely by the determination means h1.

Third Embodiment

The third embodiment is described next with reference to the drawings.

The same reference numerals and symbols are used and descriptions will be omitted here for the components that are the same as in the second embodiment because the third embodiment has the same configuration as the second embodiment except that learning means h3 learns such relationships as the correspondence relationship of the difference in the image positions in the pair of images as they correspond to the positions in the vertical direction, instead of setting the intersection angle information and the position information of the imaging devices 11 in advance, and that the determination of the positions of the support pin 6 and the core a by the determination means h1 is different. The configurations that are different from the second embodiment will be mainly described. In the third embodiment, the reference position is the position of the intersection o assuming that the pair of imaging devices 11 (for example, the first imaging device 11*a* and the second imaging device 11*b*) are installed accurately.

Figure 26:
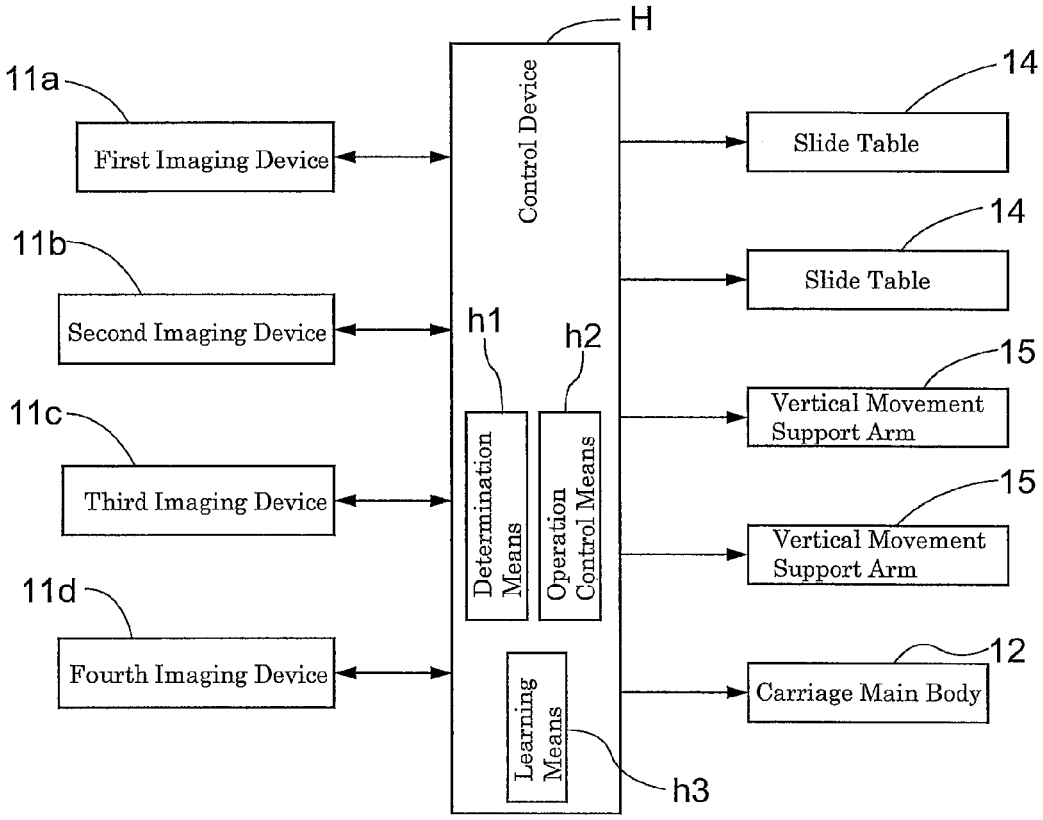
FIG. 26 is a control block diagram of the third embodiment.

As shown in FIG. 26, in addition to the determination means h1 and the operation control means h2, the control device H includes learning means h3 for learning the difference between the image positions of the detected object in the pair of images of the detected object captured by the pair of imaging devices that corresponds to the vertical direction.

Figure 22:
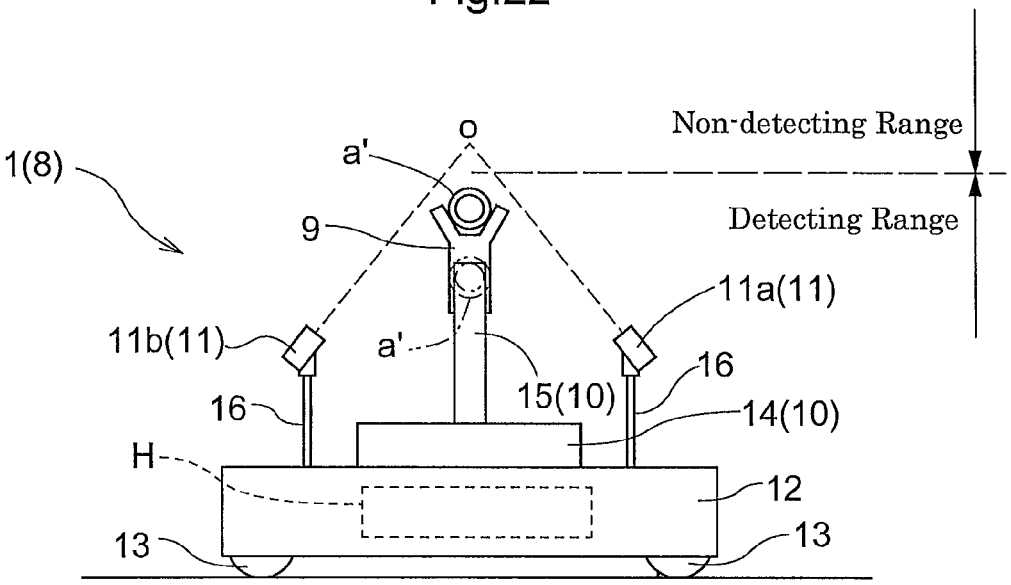
FIG. 22 shows the first detection location and the second detection location in an experiment.
Figure 23:
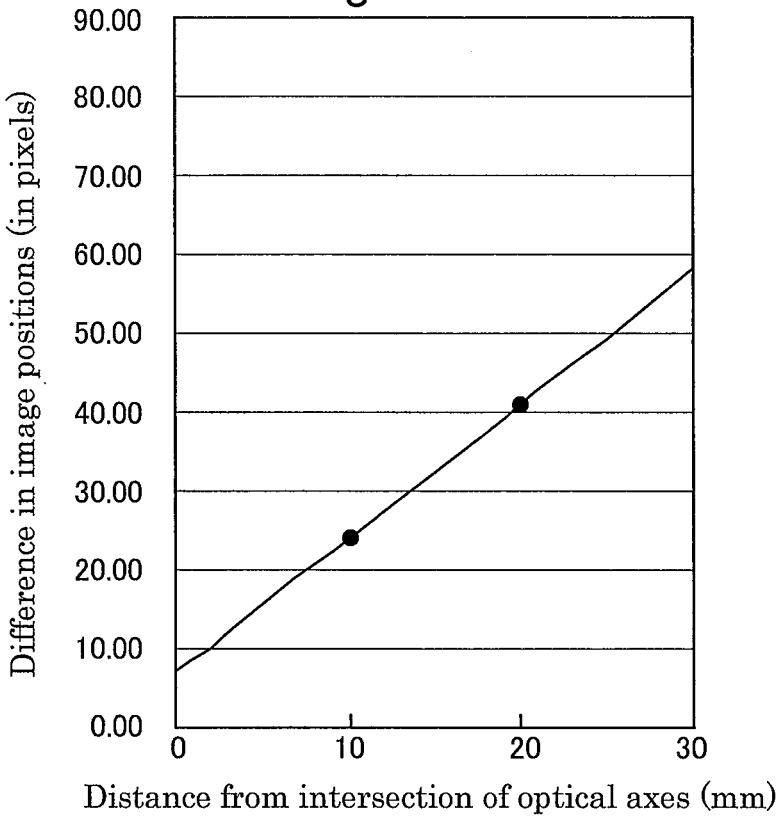
FIG. 23 shows a learned relationship in the third embodiment.

As shown in FIG. 22, this learning means h3 is configured to learn the correspondence relationship between the differences (amount of displacement) of the image position of the learning purpose detected object a' that corresponds to the vertical direction in the pair of images captured by the pair of imaging devices 11 based on the difference (or parallax) of the image positions of a learning purpose detected object a' in the pair of images that are captured by the pair of imaging devices 11 and that are of the learning purpose detected object a' (shown with solid lines in FIG. 22) located in the first detection location, on the difference (or parallax) of the image positions of the learning purpose detected object a' (shown with imaginary lines in FIG. 22) in the pair of images that are captured by the pair of imaging devices 11 and that are of the learning purpose detected object a' located in the second detection location and on the vertical positions of the first detection location and the second detection location.

The first detection location is set within the detecting range and between the pair of imaging devices 11 in the vehicle body fore and aft direction. And the second detection location is set within the detecting range, and between the pair of imaging devices 11 in the vehicle body fore and aft direction, and is displaced downwardly from the first detection location. In addition, in this learning, the line segment that connects the first detection location and the second detection location is set to pass through the intersection o when the pair of imaging devices 11 are installed or mounted accurately. And the first detection location is set to be at a location 10 mm below the intersection o, and the second detection location is set to be at a location 20 mm below the intersection o. Also, a detected member (a dummy) that is formed to have the same shape as the core a is used as the learning purpose detected object a'. In addition, a roll A which is a detected object may be used as the learning purpose detected object a' instead.

In the learning of the correspondence relationship, from the ends in the longitudinal direction of the upper edge and the lower edge of the learning purpose detected object a' in the first image captured by the first imaging device 11*a*, the intermediate position (coordinates (Xa, Ya) in the first image) of these ends is obtained first. Similarly, from the ends in the longitudinal direction of the upper edge and the lower edge of the learning purpose detected object in the image captured by the second imaging device 11*a*, the intermediate position (coordinates (Xb, Yb) in the second image) of these ends is obtained.

And next, the amount of displacement between the intermediate position of the learning purpose detected object a' in the first image and the intermediate position of the learning purpose detected object a' in the second image is calculated using the equation, square root of ((Xa−Xb)^2+(Ya−Yb)^2), based on the Pythagorean theorem.

In addition, the learning means h3 learns vertical movement relationship which is the relationship between the vertical movement amount of the vertical movement support arm 15 and the change in the amount of displacement between the first image and the second image, as the learning purpose detected object a' is moved between the first detection location and the second detection location by vertically moving one of the vertical movement support arms 15 in the vertical direction.

In addition, by using the fact that there is a proportional relationship between the movement amount of the learning purpose detected object a' in the vehicle fore and aft direction and the movement amount of the learning purpose detected object a' in the first image when so moving the learning purpose detected object a', the learning means h3 learns fore and aft movement relationship which is the relationship between the sliding amount of one of the slide tables 14 in the vehicle fore and aft direction and the movement amount of the learning purpose detected object a' in the first image by moving the slide table 14 in the vehicle fore and aft direction and thus moving the learning purpose detected object a' in the vehicle fore and aft direction by a set amount.

In addition, by using the fact that there is a proportional relationship between the movement amount of the learning purpose detected object a' in the vehicle lateral direction and the movement amount of the learning purpose detected object a' in the first image when so moving the learning purpose detected object a', the learning means h3 learns lateral movement relationship which is the relationship between the sliding amount of one of the slide tables 14 in the vehicle lateral direction and the movement amount of the learning purpose detected object a' in the first image by moving the slide table 14 in the vehicle lateral direction and thus moving the learning purpose detected object a' in the vehicle lateral direction by a set amount.

Similarly, correspondence relationship, vertical movement relationship, fore and aft movement relationship, and lateral movement relationship for the other end of the learning purpose detected object a' are learned using the third imaging device 11*c*, the fourth imaging device 11*d*, the other of the vertical movement support arms 15, and the other of the slide tables 14.

Thus, before or after the automated roll transport vehicle 1 is installed in the roll transport facility, and with the learning purpose detected object a' that has the same shape as the core a being received and supported by the supporting mounts 9, the learning means h3 causes the pair of imaging devices 11 to capture the images of the learning purpose detected object a' at two or more locations by vertically moving the learning purpose detected object a'. The learning means h3 is configured to learn the correspondence relationship between the difference of the learning purpose detected object a' (core a) in the images captured by the pair of imaging devices 11 and the vertical position of the learning purpose detected object a' (core a) based on the parallax of the learning purpose detected object a' in the pair of images for each location and on the vertical position of the learning purpose detected object a' for each location. In addition, the learning means h3 is configured to learn the relationship (vertical movement relationship, fore and aft movement relationship, lateral movement relationship) between the movement amount of the learning purpose detected object a' (core a) by the moving operation means 10 and the movement amount in the first image captured by the first imaging device 11*a*.

Determination of the positions of the support pin 6 and the core a by the determination means h1 is described next.

Figure 24:
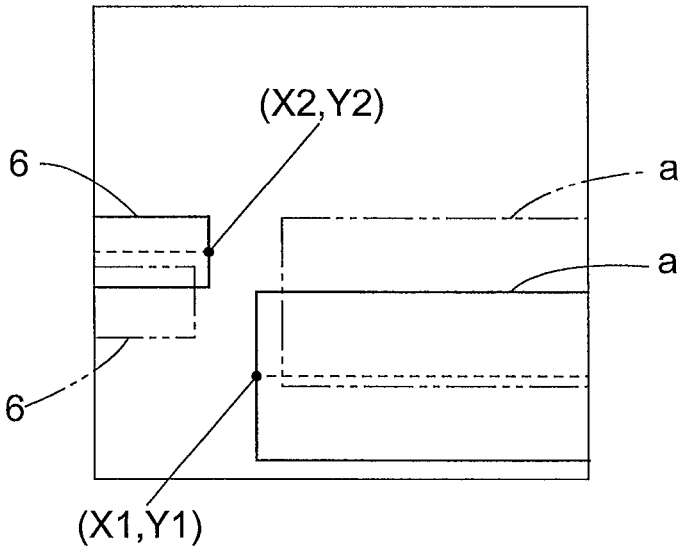
FIG. 24 shows the first image in the third embodiment.

Based on the image information captured by the first imaging device 11*a*, and from the ends in the longitudinal direction of the upper edge and the lower edge of the core a in the first image, the position of the intermediate position between these ends in the image vertical direction and the image lateral direction (see FIG. 24: coordinates (X1, Y1) of the core a in the first image) is obtained. In addition, based on the image information captured by the first imaging device 11*a*, and from the ends in the longitudinal direction of the upper edge and the lower edge of the support pin 6 in the first image, the position of the intermediate position between the ends in the image vertical direction and the image lateral direction (see FIG. 24: coordinates (X2, Y2) of the support pin 6 in the first image) is obtained.

Figure 25:
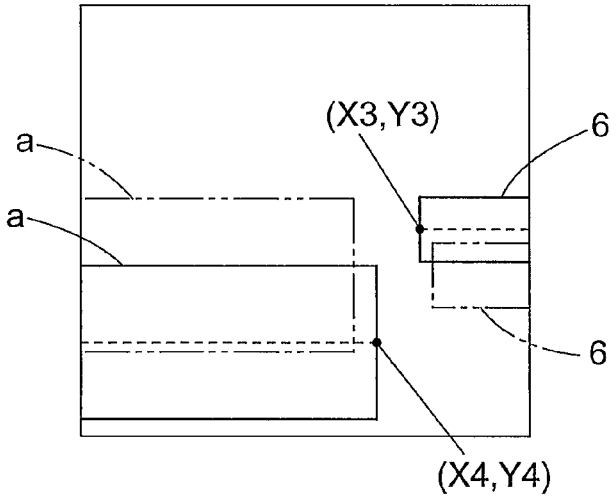
FIG. 25 shows the second image in the third embodiment.

And, based on the image information captured by the second imaging device 11*b*, and from the ends in the longitudinal direction of the upper edge and the lower edge of the core a in the second image, the position of the intermediate position between these ends in the image vertical direction and the image lateral direction (see FIG. 25: coordinates (X4, Y4) of the core a in the second image) is obtained. And, based on the image information captured by the second imaging device 11*b*, and from the ends in the longitudinal direction of the upper edge and the lower edge of the support pin 6 in the second image, the position of the intermediate position between these ends in the image vertical direction and the image lateral direction (see FIG. 25: coordinates (X3, Y3) of the support pin 6 in the second image) is obtained.

And the position (Pc) of the core a in the vertical direction with respect to the reference position (position of the intersection o assuming that the first imaging device 11*a* and the second imaging device 11*b* are installed accurately) in the detecting range is determined, based on the difference (parallax) Gc of the intermediate positions (image positions) of the core a in the pair of images (the first image and the second image) and on the correspondence relationship learned by the learning means h3. And the position (Pp) of the support pin 6 in the vertical direction with respect to the reference position in the detecting range is determined based on the difference (parallax) Gc of the intermediate positions (image positions) of the support pin 6 in the pair of images (the first image and the second image) and on the correspondence relationship learned by the learning means h3.

The amount of displacement between the support pin 6 and the core a in the vertical direction can be obtained as the difference (Pc−Pp) between their positions with respect to the reference position. To this end, the operation of the vertical movement support arm 15 is controlled by the operation control means h2 to move the core a in the vertical direction based on the difference (Pc−Pp) between the positions of the support pin 6 and the core a with respect to the reference position and on the vertical movement relationship in order to eliminate the amount of displacement between the support pin 6 and the core a in the vertical direction, thus to match their positions in the vertical direction.

After this operation, to eliminate the amount of displacement (X1-X2), in the image vertical direction, between the core a in the first image and the support pin 6 in the first image, the operation of the slide table 14 is controlled by the operation control means h2 to move the core a in the vehicle fore and aft direction based on this displacement amount and on the fore and aft movement relationship.

In addition, in order to cause the amount of displacement (Y1-Y2) between the core a in the first image and the support pin 6 in the first image in the image lateral direction to be equal to a predetermined amount of displacement, the operation of the slide table 14 is controlled by the move control means h2 based on this amount of displacement and on the lateral movement relationship to move the core a in the vehicles lateral direction.

In short, it takes extra efforts to install the imaging devices in the second embodiment because the installing position information and the installation angle information for the pair of imaging devices are provided to the determination means and because it is necessary to install the pair of imaging devices with sufficient accuracy such that they are at the installation positions with the installation angles in the second embodiment. In contrast, in the third embodiment, by learning the relationship between the position in the depth-wise direction of the learning purpose detected object and the difference between the image positions of the learning purpose detected object in the pair of images captured by the pair of imaging devices, installation of the imaging devices is facilitated because the position of the detected object can be determined from the difference between the image positions of the detected object in the pair of images captured by the pair of imaging devices and the relationship obtained by the learning process even if the accuracy of installation of the imaging devices is somewhat low.

Alternative Embodiments (1) In the embodiments described above, the moving operation means 10 is configured to move each of the both ends of the core a to be able to change the attitude of the core a in addition to being able to move the core a. And provided as the imaging devices 11 are a pair of one side imaging devices consisting of the first imaging device 11*a* and the second imaging device 11*b* with their imaging directions intersecting each other as seen along the axis of the core a as well as a pair of the other side imaging devices consisting of the third imaging device 11*c* and the fourth imaging device 11*d* with their imaging directions intersecting each other as seen along the axis of the core a. And the control means H is configured to control the operation of the moving operation means 10 to locate the core a in the proper position by causing one end portion of the core a to be moved in the vertical direction, the vehicle body lateral direction, and in the vehicle body fore and aft direction based on the image information from the one side imaging devices to locate or place the one end portion of the core a in the one end portion proper position, and by causing the other end portion of the core a to be moved in the vertical direction, the vehicle body lateral direction, and in the vehicle body fore and aft direction based on the image information from the other side imaging devices to locate or place the other end portion of the core a in the other end portion proper position. However, the configurations of these moving operation means 10, the imaging devices 11, and the control means H may be modified suitably.

More specifically, for example, the moving operation means 10 may be configured to move both ends of the core a in unison in the vertical direction, the vehicle body lateral direction, and in the vehicle body fore and aft direction such that the movement of the core a is possible only with the attitude of the core a being maintained. The first imaging device 11*a* and the second imaging device 11*b* with their imaging directions intersecting each other as seen along the axis of the core a may be provided as the imaging devices 11. And the control means H may be configured to control the operation of the moving operation means 10 to move the core to the proper position by causing both ends of the core a to be moved in unison in the vertical direction, the vehicle body lateral direction, and in the vehicle body fore and aft direction based on the image information from the first imaging device 11*a* and the second imaging device 11*b*.

In addition, for example, only the first imaging device 11*a* and the third imaging device 11*c* may be provided as the imaging devices 11. And the control means H may be configured: to determine the positions and the sizes of the core a and the support pin 6 in the image captured by the first imaging device 11*a*; to determine the positions and the sizes of the core a and the support pin 6 in the image captured by the third imaging device 11*c*; to cause one end portion of the core a to be located in the one end portion proper position based on the image information from the first imaging device 11*a*; to cause the other end portion of the core a to be located in the other end portion proper position based on the image information from the third imaging device 11*c*; and to control the operation of the moving operation means 10 to locate the core a in the proper position.

In short, while the moving operation means 10 was configured to be able to move each end of the core a separately in the vertical direction, the vehicle body lateral direction, and in the vehicle body fore and aft direction, the moving operation means 10 may be configured to move both ends of the core a in unison in the vertical direction, the vehicle body lateral direction, and in the vehicle body fore and aft direction. Or the moving operation means 10 may be configured to move both ends of the core a in one or two of the vertical direction, the vehicle body lateral direction, and the vehicle body fore and aft direction.

In addition, although four imaging devices were provided as the imaging devices 11, one, two, or three of the four imaging devices may be provided as the imaging device 11.

(2) In the embodiments described above, the images of the device side support element 6 and the core a are captured simultaneously by one imaging device 11. However, the image of one of the device side support element 6 and the cores a may be captured by the one imaging device 11, after which, the imaging direction of the imaging device 11 may be changed or the imaging device may be moved in order to capture the image of the other of the device side support element 6 and the cores a, so that the images of the device side support element 6 and the core a are captured by one imaging device 11 at different times.

In addition, the imaging devices 11 may comprise an imaging device for the device for capturing the device side support element 6 and an imaging device for the core for capturing the core a so that the images of the device side support element 6 and the core a may be captured simultaneously or at different times by these two imaging devices.

(3) In the first embodiment described above, the control means H is configured to obtain the amount of displacement z of the core a in the vehicle body lateral direction with respect to the proper position based on the image information captured by the straight forward view imaging devices (the one side straight forward view imaging device 11*a* and the other side straight forward view imaging device 11*c*), and to obtain the amount of displacement y of the core a with respect to the proper position in the vertical direction and the amount of displacement x in the vehicle body fore and aft direction based on both the image information captured by the straight forward view imaging devices 11*a*, 11*c* and the image information captured by the angular view imaging device (the one side angular view imaging device 11*b* and other side angular view imaging device 11*d*). However, the configuration of the control means H may be modified to suit a given situation. For example, the control means H may be configured to obtain the amount of displacement y of the core a with respect to the proper position in the vertical direction and the amount of displacement z of the core a in the vehicle body lateral direction based on the image information captured by the straight forward view imaging devices 11*a*, 11*c*, and to obtain the amount of displacement x with respect to the proper position in the vehicle body fore and aft direction based on both the image information captured by the straight forward view imaging devices 11*a*, 11*c* and the image information captured by the angular view imaging device 11*b*, 11*d*.

(4) In the embodiment described above, the imaging device 11 are provided to the carriage main body 12. However, the imaging devices 11 may be provided to the transport vehicle side support elements 9 such that the imaging devices 11 move integrally with the transport vehicle side support elements 9.

When providing the imaging devices 11 to the transport vehicle side support elements 9, the imaging devices 11 may capture images only of the core a between the device side support element 6 and the cores a. And the control means H may be configured to control the operation of the moving operation means 10 to locate the core a in the proper position based on the image information in which the images only of the core a are captured by the imaging devices 11.

(5) In the embodiments described above, the positions and the directions of the pair of imaging devices 11, whose imaging directions intersect each other as seen in the axis of the core a, may be modified suitably.

For example, there may be provided an imaging device that is located rearwardly of, and vertically within the vertical moving range of, the core a which is moved by the moving operation means 10 and that is arranged in an attitude such that it captures the images in the horizontal direction, as well as an imaging device that is located downwardly of, and within the moving range in the vehicle fore and aft direction of, the core a which is moved by the moving operation means 10 and that is arranged in an attitude such that it captures the images in the vertical and upward direction.

(6) In the embodiments described above, a pair of imaging devices 11 are separately located at positions such that their distances from the intersection o of the optical axes are equal to each other, and such that the intersecting angles of their optical axes with the line segments that are parallel to the depth-wise direction are equal to each other. However, the pair of imaging devices 11 may be separately located at such positions that their distances from the intersection o of the optical axes are different from each other. And the pair of imaging devices 11 may be separately located at such positions that the intersecting angles of their optical axes with the line segments that are parallel to the depth-wise direction are different from each other.

In either case, the detecting range is a range spaced away from the intersection o of the optical axes by a distance that is greater than a set distance on the closer side (or far side) of the intersection of the optical axes.

(7) In the second embodiment described above, the determination means is configured: to detect the positions of both edges of the detected object in the direction corresponding to the depth-wise direction in each of the pair of images captured by the pair of imaging devices; to obtain the center position of the detected object in the direction corresponding to the depth-wise direction in each of the pair of images from the positions of both edges of the detected object; and to determine the position of the detected object with respect to the reference position in the depth-wise direction based on the difference between the center positions of the detected object in each of the pair of images. However, the determination means may be configured: to detect the position of one of the edges of the detected object in the direction corresponding to the depth-wise direction in each of the pair of images captured by the pair of imaging devices, and to determine the position of the detected object with respect to the reference position in the depth-wise direction based on the positions of the one edge of the detected object in each of the pair of images.

(8) In the second and third embodiments described above, the determination means is configured to determine the position of the detected object with respect to the reference position in three directions consisting of a direction that extends along the first imaginary line and a direction that is perpendicular to the depth-wise direction and to the direction that extends along the first imaginary line in addition to the depth-wise direction. However, the determination means may be configured to determine the position of the detected object with respect to the reference position only in one direction, i.e. the depth-wise direction. In addition, the determination means may be configured to determine the position of the detected object with respect to the reference position in two directions consisting of a direction that extends along the first imaginary line, or a direction that is perpendicular to the depth-wise direction and to the direction that extends along the first imaginary line, in addition to the depth-wise direction.

More specifically, when the determination means is configured to determine the position of the detected object with respect to the reference position only in one depth-wise direction, the determination means may be configured to determine the position of the detected object on a line segment that is parallel to the depth wise direction and that passes through the intersection of the optical axes based on the image positions of the detected object in the pair of images captured by the pair of imaging devices, and to determine the position of the detected object with respect to the reference position only in one depth-wise direction.

(9) In the second embodiment described above, the position of the detected object with respect to the reference position in the direction that is perpendicular to both the depth-wise direction and the direction that extends along the first imaginary line is determined based on the image position of the detected object in one image captured by one imaging device. However, the position of the detected object with respect to the reference position in the direction that is perpendicular to both the depth-wise direction and the direction that extends along the first imaginary line may be determined based on the image positions of the detected object in a pair of images captured by a pair of imaging devices.

(10) In the second and third embodiments described above, the movable body is a roll moving transport vehicle 1. And the position of the device side support element with respect to the transport carriage 8 is determined by the determination means h1 based on the image information in which an image of the device side support element is captured. And the operation control means h2 is configured to control the operation of the moving operation means 10 to locate the core a in the proper position based on the determined position of the device side support element. However, the detected object captured by a pair of imaging devices 11 or the object that is moved by the moving operation means 10 may be changed suitably. For example, the movable body may be a transport vehicle having a transport means such as a conveyer. And the position of the transported object with respect to the transport carriage 8 may be determined by the determination means h1 based on the image information in which an image of the transported object is captured. And the operation control means h2 may be configured to control the operation of the moving operation means 10 to locate the transported object in the proper position at which the transported object can be received based on the determined position of the transported object.

In addition, the pair of imaging devices 11 may be provided at fixed locations of the facility in which the transport carriage 8 is provided and the detected object 6 may be provided to a movable body main body. Thus, it is not necessary to provide the pair of imaging devices 11 in the movable body.

In this case, the reference position is set to be a fixed location in the facility in which the transport carriage 8 is provided.

(11) In the second and third embodiments described above, the pair of imaging devices are positioned such that the vertical direction is the depth-wise direction. However, the pair of imaging devices may positioned such that the vehicle body fore and aft direction or the vehicle body lateral direction is the depth-wise direction.

(12) In the second embodiment, both the core a and the device side support element 6 are the detected objects. However, only the device side support element 6 may be the detected object. In this case, the position of the core a with respect to the reference position may be determined by providing, to automated roll transport vehicle, sensors and other things that function as core position determination devices for determining the position of the core a with respect to the reference position in the vertical direction, the vehicle fore and aft direction, and in the vehicle lateral direction.

(13) In the third embodiment described above, an example is disclosed in which the position (Pc) of the core a with respect to the reference position in the vertical direction is determined from the parallax Gc of the core a in the pair of images in the first image and the second image and based on the correspondence relationship: the position (Pp) of the support pin 6 with respect to the reference position in the vertical direction is determined from the parallax Gp of the support pin 6 in the pair of images in the first image and the second image and based on the correspondence relationship: and the amount of displacement in the vertical direction between the support pin 6 and the core a is obtained from the difference (Pc−Pp) of these positions. Instead, the amount of displacement in the vertical direction between the support pin 6 and the core a may be obtained directly from the difference between the parallax Gc of the core a and the parallax Gp of the support pin 6 in the pair of images consisting of the first image and the second image based on the correspondence relationship which is a linear relationship.

(14) In the embodiments described above, the transport carriage 8 is configured to be of a non-track type which travels automatically along with guiding line provided on the floor. However, the transport carriage 8 may be of a track type which travels automatically along a guide rail while guided by the guide rail provided on the floor.

INDUSTRIAL APPLICABILITY

The automated roll transport facility in accordance with the present invention may be utilized in a production facility in which printing or spraying is performed on the surface of printing stencil paper or various film originals.

DESCRIPTION OF REFERENCE NUMERALS AND SYMBOLS

2 Receiving Device
6 Device Side Support Element
8 Transport Carriage
9 Transport Vehicle Side Support Element
10 Moving Operation Means
11 Imaging Device
11*a* First Imaging Device
11*b* Second Imaging Device
11*c* Third Imaging Device
11*d* Fourth Imaging Device
12 Carriage Main Body
A Roll
a Detected object, Core
a' Learning Purpose Detected Object
H Control Means
h1 Determination Means
h2 Operation Control Means
h3 Learning Means

The invention claimed is:

1. An automated roll transport facility comprising:

a receiving device that is fixedly provided, the receiving device including a pair of device side support elements that are configured to be moved between first positions and second positions at which the pair of device side support elements are farther apart from each other than at the first positions and that are configured to support both ends of a core, that is located at a center of a roll, when the pair of device side support elements are at the first positions;

a transport vehicle side support element, separate from the receiving device, for supporting the roll upwardly of a transport carriage such that the roll can be transferred to the receiving device;

moving operation device for moving the core of the roll supported by the transport vehicle side support element with respect to the transport carriage;

a controller for controlling an operation of the moving operation device to locate the core in a core proper position at which both ends of the core can be supported by the pair of device side support elements with the transport carriage stopped at a transfer location at which the roll is transferred to the receiving device;

wherein the transport vehicle side support element, the moving operation device, and the controller are provided to the transport carriage;

at least one imaging device provided to the transport carriage for capturing an image or images of at least one of the pair of the device side support elements;

wherein the controller is configured to control operation of the moving operation device to locate the core in the core proper position based on image information captured by the at least one imaging device, wherein the at least one imaging device comprises a first imaging device and a second imaging device whose optical axes intersect each other at an intersection; and wherein a determination portion included in the controller is configured to define a non-detecting range to be a range whose distance in a depth-wise direction from the intersection of the optical axes is less than a set distance and which is defined on a closer side and on a far side of the intersection of the optical axes, and in which a determination of a position, with respect to a reference position, of a detected object, which is the core or one of the pair of the device side support elements, becomes unreliable, and to define a detecting range to be a range whose distance in the depth-wise direction from the intersection of the optical axes is greater than or equal to the set distance and which is defined on the closer side or on the far side of the intersection of the optical axes and which is within fields of view of the first imaging device and the second imaging device, and to determine the position with respect to the reference position in the depth-wise direction of the detected object in the detecting range based on a difference between image positions of the detected object in the pair of images captured by the first imaging device and the second imaging device.

2. The automated roll transport facility as defined in claim 1, wherein a learning portion is provided for learning a correspondence relationship between a difference between the image positions of a learning purpose detected object in a pair of images captured by the first imaging device and the second imaging device, and the position of the learning purpose detected object in the depth-wise direction, based: on a difference of image positions of the learning purpose detected object in a pair of images captured by the first imaging device and the second imaging device when the learning purpose detected object is located in a first detection location that is located within the detecting range and between the first imaging device and the second imaging device in a direction that extends along the first imaginary line; on a difference of image positions of the learning purpose detected object in a pair of images captured by the first imaging device and the second imaging device when the learning purpose detected object is located in a second detection location that is located within the detecting range and between the first imaging device and the second imaging device in a direction that extends along the first imaginary line and that is displaced from the first detection location in the depth-wise direction; and on positions of the first detection location and the second detection location in the depth-wise direction, and wherein the determination portion is configured to determine the position of the detected object within the detecting range and with respect to the reference position in the depth-wise direction based on the difference between the image positions of the detected object in the pair of images captured by the first imaging device and the second imaging device and on the correspondence relationship learned by the learning portion.

3. The automated roll transport facility as defined in claim 1, wherein the determination portion is configured to define a non-detecting range to be a range whose distance from the intersection of the optical axes is less than the set distance and which is further defined in the depth-wise direction beyond the intersection of the optical axes, and to define a detecting range to be a range whose distance from the intersection of the optical axes is greater than or equal to the set distance and which is defined in the depth-wise direction within the closer side of the intersection of the optical axes, and to determine the position of the detected object in the detecting range with respect to the reference position in the depth-wise direction based on image information captured by the first imaging device and the second imaging device.

4. The automated roll transport facility as defined in claim 1, wherein the first imaging device and the second imaging device that are separately located at locations at which their distances from the intersection of the optical axes are equal to each other and at which intersecting angles of the optical axes with line segments that are parallel to the depth-wise direction are equal to each other.

5. The automated roll transport facility as defined in claim 1, wherein the determination portion is configured: to determine positions of both edges of the detected object in a direction corresponding to the depth-wise direction in each of a pair of images captured by the first imaging device and the second imaging device; to obtain a center position of the detected object in a direction corresponding to the depth-wise direction from the positions of the both ends of the detected object; and to determine a position of the detected object in the detecting range with respect to the reference position in the depth-wise direction based on a difference between the center positions of the detected object in the pair of images.

6. The automated roll transport facility as defined in claim 1, wherein the determination portion is configured to determine a position of the detected object with respect to the reference position in a direction parallel to the first imaginary line or in a direction that is perpendicular to the depth-wise direction and to the direction parallel to the first imaginary line, in addition to along the depth-wise direction based on image information captured by the first imaging device and the second imaging device.

7. An automated roll transport facility comprising:

a receiving device that is fixedly provided, the receiving device including a pair of device side support elements that are configured to be moved between first positions and second positions at which the pair of device side support elements are farther apart from each other than at the first positions and that are configured to support both ends of a core, that is located at a center of a roll, when the pair of device side support elements are at the first positions;

a transport vehicle side support element, separate from the receiving device, for supporting the roll upwardly of a transport carriage such that the roll can be transferred to the receiving device;

moving operation device for moving the core of the roll supported by the transport vehicle side support element with respect to the transport carriage;

a controller for controlling an operation of the moving operation device to locate the core in a core proper position at which both ends of the core can be supported by the pair of device side support elements with the transport carriage stopped at a transfer location at which the roll is transferred to the receiving device;

wherein the transport vehicle side support element, the moving operation device, and the controller are provided to the transport carriage;

at least one imaging device provided to the transport carriage for capturing an image or images of at least one of the pair of device side support elements;

wherein the controller is configured to control operation of the moving operation device to locate the core in the core proper position based on image information captured by the at least one imaging device, wherein the at least one imaging device comprises a first imaging device and a second imaging device whose optical axes intersect each other at an intersection, wherein the controller includes a determination portion for determining a position of the core with respect to a reference position in a depth-wise direction that is directed from a closer side toward a far side and that extends along a second imaginary line that extends perpendicular to a first imaginary line that connects the first imaging device and the second imaging device and that passes through the intersection of the optical axes, based on the difference between the image positions of the core in the pair of images captured by the first imaging device and the second imaging device, and wherein the determination portion is configured to define a non-detecting range to be a range whose distance in the depth-wise direction from the intersection of the optical axes is less than a set distance and which is defined on the closer side and on the far side of the intersection of the optical axes, and in which a determination of a position, with respect to the reference position, of a detected object, which is the core or one of the pair of device side support elements, becomes unreliable, and to define a detecting range to be a range whose distance in the depth-wise direction from the intersection of the optical axes is greater than or equal to the set distance and which is defined on the closer side or on the far side of the intersection of the optical axes and which is within fields of view of the first imaging device and the second imaging device, and to determine the position with respect to the reference position in the depth-wise direction of the detected object in the detecting range based on a difference between image positions of the detected object in the pair of images captured by the first imaging device and the second imaging device.

8. The automated roll transport facility as defined in claim 7, wherein a learning portion is provided for learning a correspondence relationship between a difference between the image positions of a learning purpose detected object in a pair of images captured by the first imaging device and second imaging device, and the position of the learning purpose detected object in the depth-wise direction, based: on a difference of image positions of the learning purpose detected object in a pair of images captured by the first imaging device and the second imaging device when the learning purpose detected object is located in a first detection location that is located within the detecting range and between the first imaging device and the second imaging device in a direction that extends along the first imaginary line; on a difference of image positions of the learning purpose detected object in a pair of images captured by the first imaging device and the second imaging device when the learning purpose detected object is located in a second detection location that is located within the detecting range and between the first imaging device and the second imaging device in a direction that extends along the first imaginary line and that is displaced from the first detection location in the depth-wise direction; and on positions of the first detection location and the second detection location in the depth-wise direction, and wherein the determination portion is configured to determine the position of the detected object within the detecting range and with respect to the reference position in the depth-wise direction based on the difference between the image positions of the detected object in the pair of images captured by the first imaging device and the second imaging device and on the correspondence relationship learned by the learning means.

9. The automated roll transport facility as defined in claim 7, wherein the determination portion is configured to define a non-detecting range to be a range whose distance from the intersection of the optical axes is less than the set distance and which is further defined in the depth-wise direction beyond the intersection of the optical axes, and to define a detecting range to be a range whose distance from the intersection of the optical axes is greater than or equal to the set distance and which is defined in the depth-wise direction within the closer side of the intersection of the optical axes, and to determine the position of the detected object in the detecting range with respect to the reference position in the depth-wise direction based on image information captured by the first imaging device and the second imaging device.

10. The automated roll transport facility as defined in claim 7, wherein the first imaging device and the second imaging device are separately located at locations at which their distances from the intersection of the optical axes are equal to each other and at which intersecting angles of the optical axes with line segments that are parallel to the depth-wise direction are equal to each other.

11. The automated roll transport facility as defined in claim 7, wherein the determination portion is configured: to determine positions of both edges of the detected object in a direction corresponding to the depth-wise direction in each of a pair of images captured by the first imaging device and the second imaging device; to obtain a center position of the detected object in a direction corresponding to the depth-wise direction from the positions of the both ends of the detected object; and to determine a position of the detected object in the detecting range with respect to the reference position in the depth-wise direction based on a difference between the center positions of the detected object in the pair of images.

12. The automated roll transport facility as defined in claim 7, wherein the determination portion is configured to determine a position of the detected object with respect to the reference position in a direction parallel to the first imaginary line or in a direction that is perpendicular to the depth-wise direction and to the direction parallel to the first imaginary line, in addition to along the depth-wise direction based on image information captured by the first imaging device and the second imaging device.

* * * * *